US011113929B1

(12) United States Patent
Reeder et al.

(10) Patent No.: US 11,113,929 B1
(45) Date of Patent: Sep. 7, 2021

(54) INTEGRATED GAMING SYSTEM FOR PROVIDING REAL-TIME PARLAY OPTIONS THAT SATISFY USER-SUPPLIED PARLAY PARAMETERS

(71) Applicant: High Sierra Financial Corp., Carson City, NV (US)

(72) Inventors: Michael Franklin Reeder, Glenbrook, NV (US); Charles Gregory Plaxton, Austin, TX (US)

(73) Assignee: HIGH SIERRA FINANCIAL CORP., Carson City, NV (US)

( * ) Notice: Subject to any disclaimer, the term of this patent is extended or adjusted under 35 U.S.C. 154(b) by 0 days.

(21) Appl. No.: 16/843,197

(22) Filed: Apr. 8, 2020

(51) Int. Cl.
*G07F 17/32* (2006.01)

(52) U.S. Cl.
CPC ..... *G07F 17/3262* (2013.01); *G07F 17/3244* (2013.01)

(58) Field of Classification Search
CPC ..... G07F 17/3262; G07F 17/3244
See application file for complete search history.

(56) References Cited

U.S. PATENT DOCUMENTS

2012/0034974 A1* 2/2012 Amaitis ..... G06Q 50/34 463/25
2013/0217475 A1* 8/2013 Guan ..... G07F 17/3244 463/25
2016/0086441 A1* 3/2016 Cohen ..... G06F 16/9535 463/25
2017/0140605 A1* 5/2017 Lewski ..... G07F 17/323
2020/0133452 A1* 4/2020 Gupta ..... G06N 5/04
2020/0294364 A1* 9/2020 Nelson ..... G07F 17/3211

* cited by examiner

*Primary Examiner* — Corbett B Coburn
(74) *Attorney, Agent, or Firm* — Campbell Stephenson LLP

(57) ABSTRACT

Various systems and methods are provided for operating an integrated gaming system that can receive one or more parlay parameters provided by a user of a gaming terminal, determine one or more available parlay options that satisfy the one or more parlay parameters, transmit the one or more available parlay options to the gaming terminal, and receive a parlay selection that corresponds to a parlay option among the one or more available parlay options.

20 Claims, 9 Drawing Sheets

INTEGRATED GAMING SYSTEM FOR PROVIDING REAL-TIME PARLAY OPTIONS THAT SATISFY USER-SUPPLIED PARLAY PARAMETERS

BACKGROUND OF THE INVENTION

Field of the Invention

This disclosure generally relates to integrated gaming systems, and more specifically relates to integrated gaming systems that are able to provide real-time parlay options that satisfy a specific set of parlay parameters provided by a user.

Description of the Related Art

Many states and other legal entities have legalized sports wagering, which gives rise to the desire for gaming systems that provide users with various wagering options, such as the ability to place a parlay wager on various sporting events or other events in environments such as grocery stores, gas stations, convenience stores, and even from the comfort of a user's own home or via his or her mobile device. However, while such systems are desirable in many respects, the creation of such systems must overcome certain challenges. For instance, in order to maximize the ability to capture market share, any such system should preferably offer users the ability to customize the parlays upon which the user would like to wager, such as by choosing certain leagues or event categories to wager upon, a date or date range of the underlying events which are being wagered upon, and even the odds that the user would like to receive in connection with any such parlay wager. While such customization is highly desirable, such functionality also creates a problem in that such customizable parlay options must be calculated and offered to the user in a very short period of time, on the order of seconds or less, so as not to lose the user's attention or to take up an undesirable amount of time in the types of venues listed above that may otherwise desire to make use of such functionality. As such, an integrated gaming system is disclosed herein that solves these problems, in addition to provide other novel and desirable functionality.

SUMMARY OF THE INVENTION

This Summary provides a simplified form of concepts that are further described below in the Detailed Description. This Summary is not intended to identify key or essential features and should therefore not be used for determining or limiting the scope of the claimed subject matter.

This disclosure generally includes methods, computer systems, computer program products, and the like, that provide for receiving one or more parlay parameters provided by a user of a gaming terminal; determining one or more available parlay options that satisfy the one or more parlay parameters; transmitting the one or more available parlay options to the gaming terminal; and receiving a parlay selection that corresponds to a parlay option among the one or more available parlay options.

BRIEF DESCRIPTION OF THE DRAWINGS

A more complete understanding of the present disclosure may be obtained by reference to the following Detailed Description when taken in conjunction with the accompanying Drawings. In the figures, the left-most digit(s) of a reference number identifies the figure in which the reference number first appears. The same reference numbers in different figures indicate similar or identical items.

DETAILED DESCRIPTION

This disclosure generally includes methods, computer systems, computer program products, and the like, that provide for receiving one or more parlay parameters provided by a user of a gaming terminal; determining one or more available parlay options that satisfy the one or more parlay parameters; transmitting the one or more available parlay options to the gaming terminal; and receiving a parlay selection that corresponds to a parlay option among the one or more available parlay options.

Figure 1A:
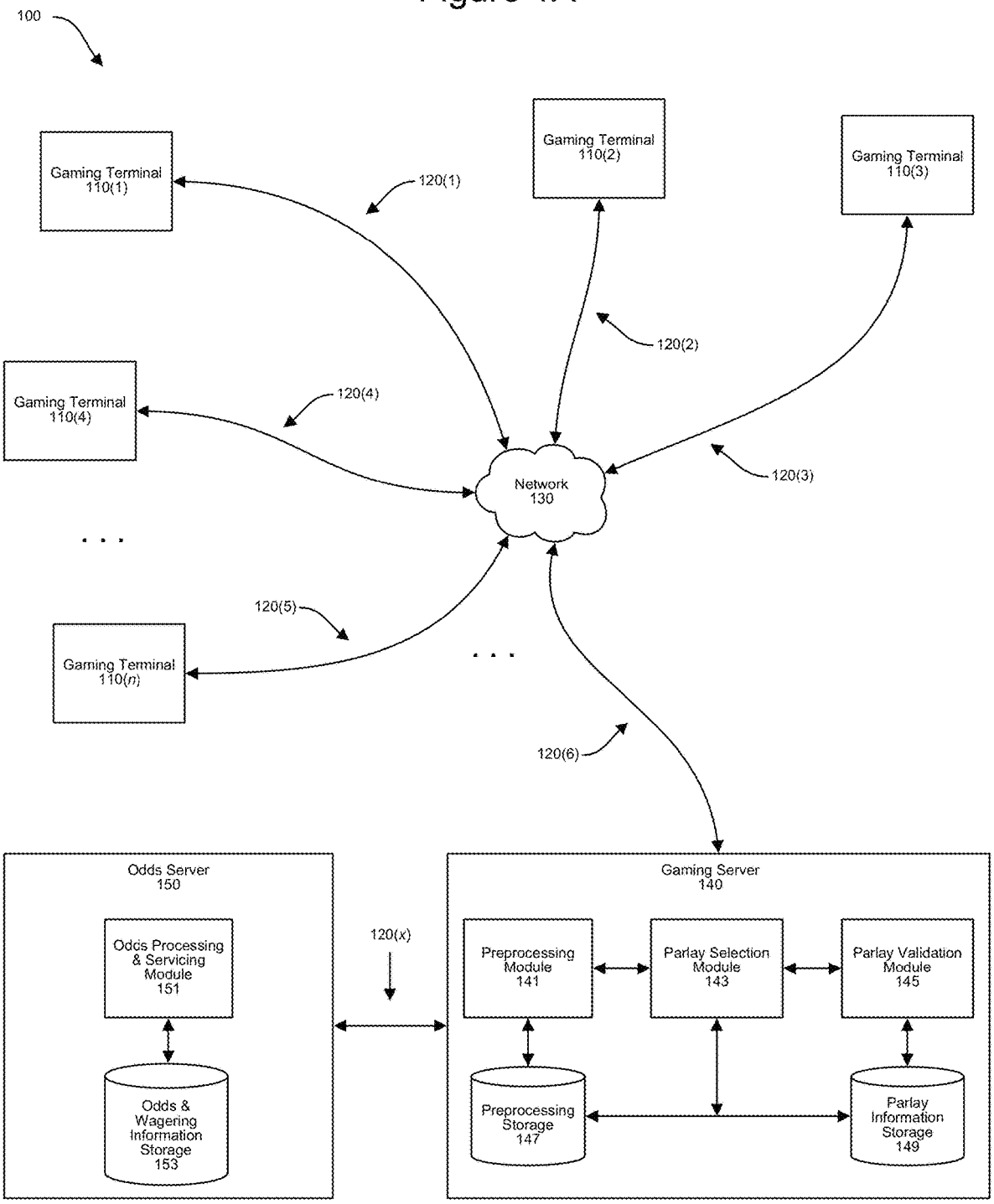
FIG. 1A is a block diagram depicting a first example of an integrated gaming system, according to one embodiment of this disclosure.

FIG. 1A illustrates a block diagram of a first example of an integrated gaming system (such as, e.g., integrated gaming system 100) that includes a plurality of Gaming Terminals, such as, e.g., Gaming Terminals 110(1)-110(*n*) (collectively, "Gaming Terminal(s) 110"). In certain embodiments, each Gaming Terminal 110 is a machine dedicated to performing a portion of the functionality described herein (e.g., the functionality disclosed in FIGS. 2A, 2B, and 3 and discussed herein in conjunction therewith), and which can be connected via one or more connections 120(1)-120(*x*) (collectively, "connection(s) 120") to a network 130, and ultimately to a Gaming Server, such as, e.g., Gaming Server 140. In certain embodiments, a Gaming Terminal 110 can be a computing terminal or other computing device dedicated to performing a portion of the functionality described herein, such as, e.g., selling lottery tickets (or similar documents) based on the results of a combination of sporting events (or other events upon which a wager can be placed). In other embodiments, each Gaming Terminal 110 can be any computing device, such as a personal computer, laptop computer, notebook computer, personal computing device (e.g., a smart phone), or any other computing device as described herein. Although not expressly shown in FIG. 1A, in certain embodiments, each Gaming Terminal 110 can also include various other components, such as a microprocessor, memory, a touchscreen input device (and/or another type of display screen), networking capabilities, and so forth.

Each Gaming Terminal 110 is connected to a Gaming Server 140 via a series of connections 120 and one or more networks 130. Each of the connections 120 can be any sort of wired and/or wireless network connection, such as an Ethernet connection, a Fiber Optic connection, a BLUETOOTH connection, and so forth, including various combinations of the foregoing technologies. Network 130 can be any sort of network, including a local area network ("LAN"), wide area network ("WAN"), storage area network ("SAN"), the Internet, an intranet, and so forth. Although only one network 130 is depicted in FIG. 1A for the sake of explanation, in practice more or less instances of network 130 can be used.

Moreover, as used throughout this disclosure, the reader will appreciate that letters such as n and x (in addition to other such letters) are used to indicate a variable number of devices or components of a similar kind. Although such letters are used in describing a variable number of instances of each of these different devices and components, a repeated use of a given letter (e.g., n) does not necessarily indicate that each device and component has a same number (e.g., n) of instances implemented in the example system discussed herein, or in any other embodiment of this invention.

As noted above, through the various connections and networks, each Gaming Terminal 110 shown in FIG. 1A is ultimately connected to a Gaming Server, such as, e.g., Gaming Server 140. In certain embodiments, Gaming Server 140 is a machine dedicated to performing a portion of the functionality described herein (e.g., the functionality disclosed in FIG. 4 and FIG. 5 and discussed herein in conjunction therewith), and which can be connected via one or more connections 120 to a network 130, and ultimately to one or more Gaming Terminals 110. In certain embodiments, a Gaming Server 140 can be a server or other computing device dedicated to performing a portion of the functionality described herein, such as, e.g., determining what parlay options are available at any given time, confirming the validity of any parlay option that has been selected after being offered, and tracking information related to such functionality.

In certain embodiments, Gaming Server 140 includes various modules that can be configured to perform one or more steps of the functionality described herein. For instance, in the embodiment shown in FIG. 1A, Gaming Server 140 includes Preprocessing Module 141, Parlay Selection Module 143, and Parlay Validation Module 145. In certain embodiments, Preprocessing Module 141 can be configured to acquire (such as, e.g., from Odds Server 150) or otherwise determine (such as, e.g., via one or more internal processes or function calls) information regarding the individual component wagers (e.g., one or more outcomes of events, proposition bets, and so forth, and their associated moneyline (or a point spread or other information that can be converted to a moneyline)) that are currently available and/or that satisfy one or more of the parlay parameters (e.g., one or more selected leagues and/or event categories, and/or a closing date and/or date range) provided by a user, all of which will be discussed in more detail below. This information can then be passed (or otherwise provided) to Parlay Selection Module 143, along with one or more other parlay parameters (e.g., the number of teams and/or events that the user desires to include in a parlay; and either the user's desired wager (e.g., ticket price) and desired payout (e.g., ticket win value), or a ratio describing the relationship between a user's desired wager (e.g., ticket price) and desired payout (e.g., ticket win value), all of which can be better understood in light of FIGS. 2A and 2B and the discussion related thereto, which is provided below). Parlay Selection Module 143 can use these inputs to determine one or more available Parlay Options, examples of which can be seen in FIG. 2B, and which will also be discussed in more detail below. After a user selects one or more Parlay Options upon which the user would like to wager (such as from among the Parlay Option(s) provided by Parlay Selection Module 143), Parlay Validation Module 145 can then validate the selected Parlay Option(s) to make sure that the selected Parlay Option(s) are still valid, which functionality will also be discussed in more detail below.

Although shown as three discrete modules in FIG. 1A, in practice, one or more of Preprocessing Module 141, Parlay Selection Module 143, and Parlay Validation Module 145 can be combined into a single module, and each of Preprocessing Module 141, Parlay Selection Module 143, and Parlay Validation Module 145 can also be split among multiple modules or processes. Moreover, as will be discussed in more detail in conjunction with FIG. 1B, although each of these modules are shown as a discrete module in FIG. 1A, in practice, one or more of these modules can be invoked (or instantiated) via one or more instances of a process and/or via one or more threads.

In certain embodiments, Gaming Server 140 includes one or more storage components that can be configured to store certain information used by and/or calculated by one or more of the components described herein, such as the various modules and other components shown in FIG. 1A. For instance, in the embodiment shown in FIG. 1A, Gaming Server 140 also includes Preprocessing Storage 147 and Parlay Information Storage 149.

In certain embodiments, Preprocessing Storage 147 can be used to store information related to a current listing of events and/or event outcomes that are available for a user to wager upon, including information such as the date and time of the event, the participants or potential outcomes of that event, and the odds related thereto, among other such information. In certain embodiments, this information can be acquired from an external server, such as, e.g., Odds Server 150. In other embodiments, this information can be calculated internally by Gaming Server 140, or can be determined via a combination of internal and external information and processes.

In certain embodiments, Parlay Information Storage 149 can be used to store information related to parlay wagers that have actually been made by users of an integrated gaming system, such as, e.g., integrated gaming system 100. For instance, Parlay Information Storage 149 can be used to record each parlay wager that was placed across the system so that, e.g., the system can eventually validate that a parlay wager was validly placed, which of course is necessary prior to paying out a user seeking to cash in a winning ticket. Parlay Information Storage 149 can also be used to track aggregate risk related to a single event (or group of events, which will be discussed in more detail below) from all wagers that have been placed across an integrated gaming system, such as, e.g., integrated gaming system 100. Tracking such aggregate risk information is important, e.g., in order to prevent a "black swan" event from financially crippling the entity or entities operating the integrated gaming system, as well as other risk control goals (e.g., to prevent a user or group of users from cheating and/or "gaming the system" through a series of coordinated bets).

Although shown as two discrete storage units in FIG. 1A, in practice, Preprocessing Storage 147 and Parlay Information Storage 149 can be combined into a single physical storage device (even if Preprocessing Storage 147 and Parlay Information Storage 149 remain logically separated while stored therein), and Preprocessing Storage 147 and Parlay Information Storage 149 can also each (or both) be split among multiple physical storage devices.

The reader will appreciate that FIG. 1A shows various connections between Preprocessing Module 141, Parlay Selection Module 143, Parlay Validation Module 145, Preprocessing Storage 147, and Parlay Information Storage 149. In practice, however, while these connections are certainly possible, they are not required, and in certain embodiments, one or more of these connections may not be preferable. The specific manner in which these modules and storage units are connected is largely a design choice, and as such can be arranged and connected in multiple configurations and architectures, so long as any given design choice allows for information to be passed from one module and/or storage unit, to another module and/or storage unit, in a manner that allows for the execution of the functionality described herein.

Moreover, although specific modules, storage units, and configuration(s) are described above, in other embodiments, Gaming Server 140 can be any computing device, such as a personal computer, laptop computer, notebook computer, server, or any other computing device that is capable of hosting and/or communicating with one or more of the associated components of Gaming Server 140, such as are shown in FIG. 1A and which will be discussed in more detail below. Although not expressly shown in FIG. 1A, each Gaming Server 140 can also include other components that are necessary for its functionality, such as a microprocessor, memory, networking capabilities, and so forth. Moreover, although only one Gaming Server 140 is depicted in FIG. 1A, in practice more than one Gaming Server can be used, and the components and/or functionality of Gaming Server 140 can be divided among multiple such servers.

Gaming Server 140 is communicably coupled to an odds server, such as, e.g., Odds Server 150. Although Gaming Server 140 is depicted in FIG. 1A as being connected to Odds Server 150 through a single connection (i.e., connection 120($x$)), in practice Gaming Server 140 and Odds Server 150 can be connected via one or more connections 120 and/or one or more networks 130. In various embodiments, Odds Server 150 can be operated by a third party, i.e., a person, company, or other organization other than the entity that owns, leases, and/or operates Gaming Server 140 and/or Gaming Terminals 110. In other embodiments, Odds Server 150 can be operated by the same entity that owns, leases, and/or operates Gaming Server 140 and/or Gaming Terminals 110. In other embodiments, Odds Server 150 (and/or the functionality thereof) can be integrated directly into Gaming Server 140 and/or Gaming Terminals 110. Nevertheless, for ease of discussion herein, Odds Server 150 will be discussed as a distinct physical and logical entity from Gaming Server 140 and Gaming Terminals 110.

In certain embodiments, Odds Server 150 is a server or other computing machine configured to store and provide (e.g., "serve") betting odds and other wagering information. Such information can include (but is neither required to be included, nor limited to) information such as the identity of the teams and/or individuals involved in a sporting event (or other event upon which wagers can be placed, all of which information will be collectively referred to herein as an "event"), information related to the logistics of the event (e.g., date, time, location, weather, and so forth), over/under "totals," moneylines, and various other "propositions" or "prop bets" (e.g., the odds of the coin flip in a football game coming up heads, the odds of the first touchdown in a football game being scored by a running back, or the odds of the last out of a baseball game being made by a certain player, among many other possibilities), among other examples. In certain embodiments, such information can be provided to a Gaming Server, such as, e.g., Gaming Server 140, which can use some or all of this information to perform various preprocessing functionality (such as, e.g., functionality performed by Preprocessing Module 141) and/or use some or all of this information to determine one or more available Parlay Options (such as, e.g., functionality performed by Parlay Selection Module 143).

In certain embodiments, Odds Server 150 includes various modules that can be configured to perform one or more steps of the functionality described herein. For instance, in the embodiment shown in FIG. 1A, Odds Server 150 includes Odds Processing and Servicing Module 151, which can be configured to process and/or serve odds and other wagering information, such as the types of odds and other wagering information described above. In certain embodiments, Odds Server 150 includes one or more storage components that can be configured to store odds and other wagering information. For instance, in the embodiment shown in FIG. 1A, Odds Server 150 includes Odds and Wagering Information Storage 153, which can be configured to store, e.g., information regarding the individual component wagers (e.g., one or more outcomes of events, proposition bets, and so forth, and their associated moneyline, or a point spread or other information that can be converted to a moneyline) that are currently available. Although depicted as a single storage unit in FIG. 1A, in practice, Odds and Wagering Information Storage 153 can also be split among multiple physical storage devices. In other embodiments, Odds Server 150 can be any computing device, such as a personal computer, laptop computer, notebook computer, server, or any other computing device that is capable of hosting and/or communicating with one or more of the associated components of Odds Server 150, such as are shown in FIG. 1A. Although not expressly shown in FIG. 1A, each Odds Server 150 can also include other components that are necessary for its functionality, such as a microprocessor, memory, networking capabilities, and so forth. Moreover, although only one Odds Server 150 is depicted in FIG. 1A, in practice more than one Odds Server can be used. In certain embodiments, the components and/or functionality of Odds Server 150 can be divided among multiple such servers. In other embodiments, multiple Odds Servers 150 can be operated by multiple entities (e.g., third-parties), in which case each Odds Server 150 may provide different odds and/or other wagering information as compared to one or more of the other Odds Servers 150.

Figure 1B:
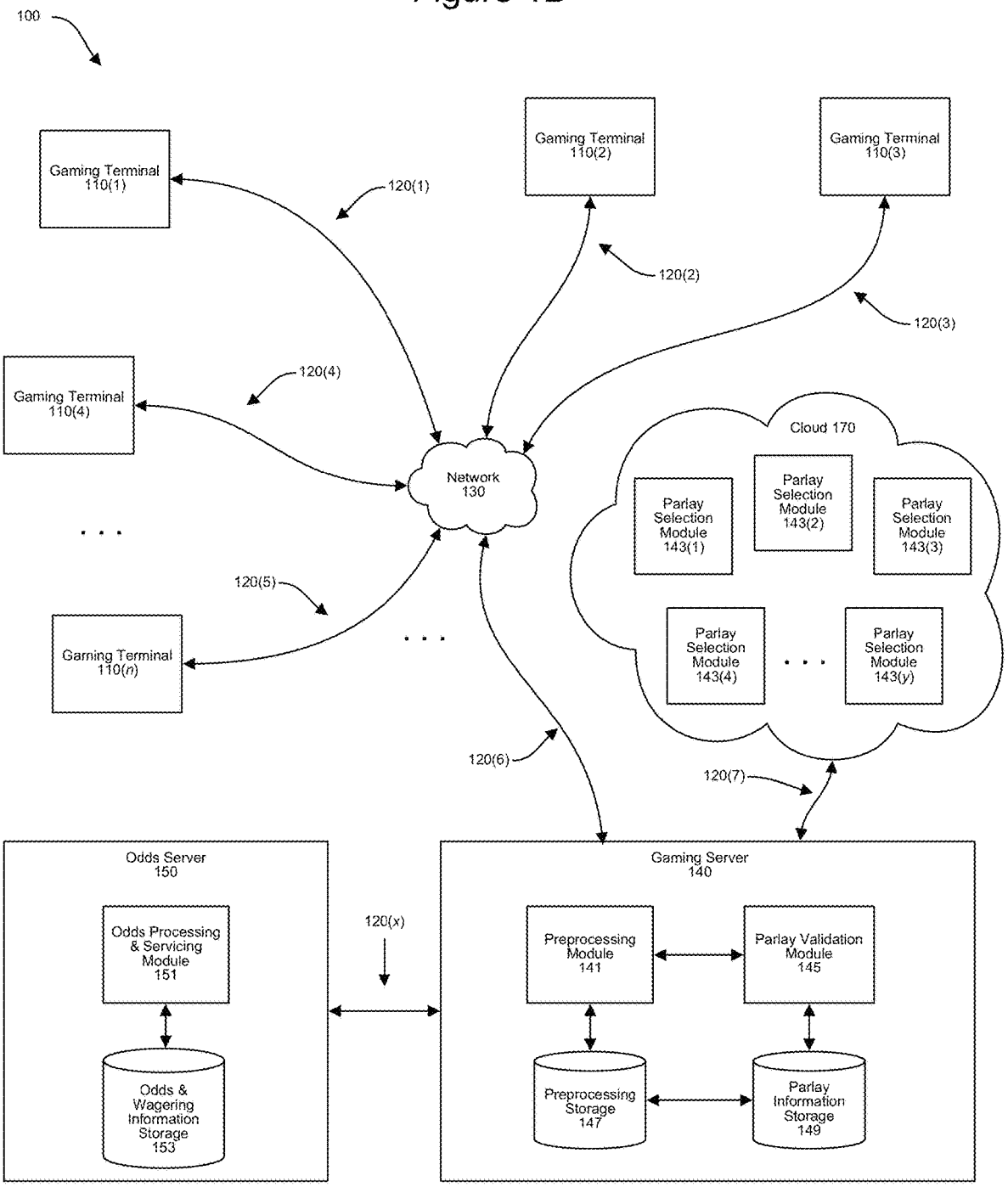
FIG. 1B is a block diagram depicting a second example of an integrated gaming system, according to one embodiment of this disclosure.

FIG. 1B illustrates a block diagram of a second example of an integrated gaming system, such as, e.g., integrated gaming system 100. The example integrated gaming system depicted in FIG. 1B is substantially the same as the example integrated gaming system depicted in FIG. 1A, with the primary difference being that Parlay Selection Module 143 is shown as being part of Gaming Server 140 in FIG. 1A, but Parlay Selection Module 143 is replaced in FIG. 1B by a plurality of Parlay Selection Modules 143(1)-143($y$) (collectively, "Parlay Selection Module(s) 143") that can be executed as individual processes (or threads, etc.) executing in a cloud (or similar) computing environment, such as, e.g., Cloud 170, which can be any cloud (or similar) computing environment. In still other embodiments, which are not expressly shown in FIG. 1A or 1B, Parlay Validation Module 145 can be replaced by a plurality of Parlay Validation Modules 145(1)-145(*z*) (collectively, "Parlay Validation Module(s) 145") that can also be executed as individual processes (or threads, etc.) executing in a cloud (or similar) computing environment, such as, e.g., Cloud 170. In still other embodiments, such as, e.g., where the parlay selection functionality and the parlay validation functionality is performed by a single module (or process, thread, etc.), then each Parlay Selection Module 143 can be combined with a Parlay Validation Module 145 (and thus form what could be referred to as a Parlay Selection and Validation Module), which can exist as either a single module on Gaming Server 140 or a plurality of modules (or individual processes, threads, etc.) operating in a cloud (such as, e.g., Cloud 170), similar to the manner in which Parlay Selection Modules 143(1)-143(*y*) are depicted in FIG. 1B and described herein.

Moreover, as the reader will appreciate, although a single cloud computing environment (i.e., Cloud 170) is shown in FIG. 1B, in practice, Cloud 170 can be divided into two or more cloud (or similar) computing environments, each of which is capable of performing all or at least part of the functionality of Cloud 170 as shown in FIG. 1B and described herein. Similarly, in practice, other components of Gaming Server 140 (and/or Gaming Terminals 110 and/or Odds Server 150) can also be executed in one or more cloud (or similar) computing environments, such as, e.g., one or more instances of Cloud 170.

Furthermore, although specific configurations are shown in FIGS. 1A and 1B, many other configurations of integrated gaming system 100 are possible. For instance, although multiple Gaming Terminals 110 are depicted in FIGS. 1A and 1B, in practice this invention can be used with a single client device. Likewise, although only a single network 130 is depicted in FIG. 1A, and a single network 130 is depicted along with Cloud 170 in FIG. 1B, in practice, the components of integrated gaming system 100 can be connected by more than one network and/or cloud (or similar) computing environment. Moreover, in certain embodiments, one or more Gaming Terminals 110 can be connected to Gaming Server 140 via one or more networks, and one or more other Gaming Terminal 110 can be connected to Gaming Server 140 via one or more other networks. Additionally, and as noted above, although one instance of Gaming Server 140 and one instance of Odds Server 150 are shown in FIGS. 1A and 1B, in practice, more than one instance of Gaming Server 140 and/or Odds Server 150 can be used. Other configurations are possible as well.

Figure 2A:
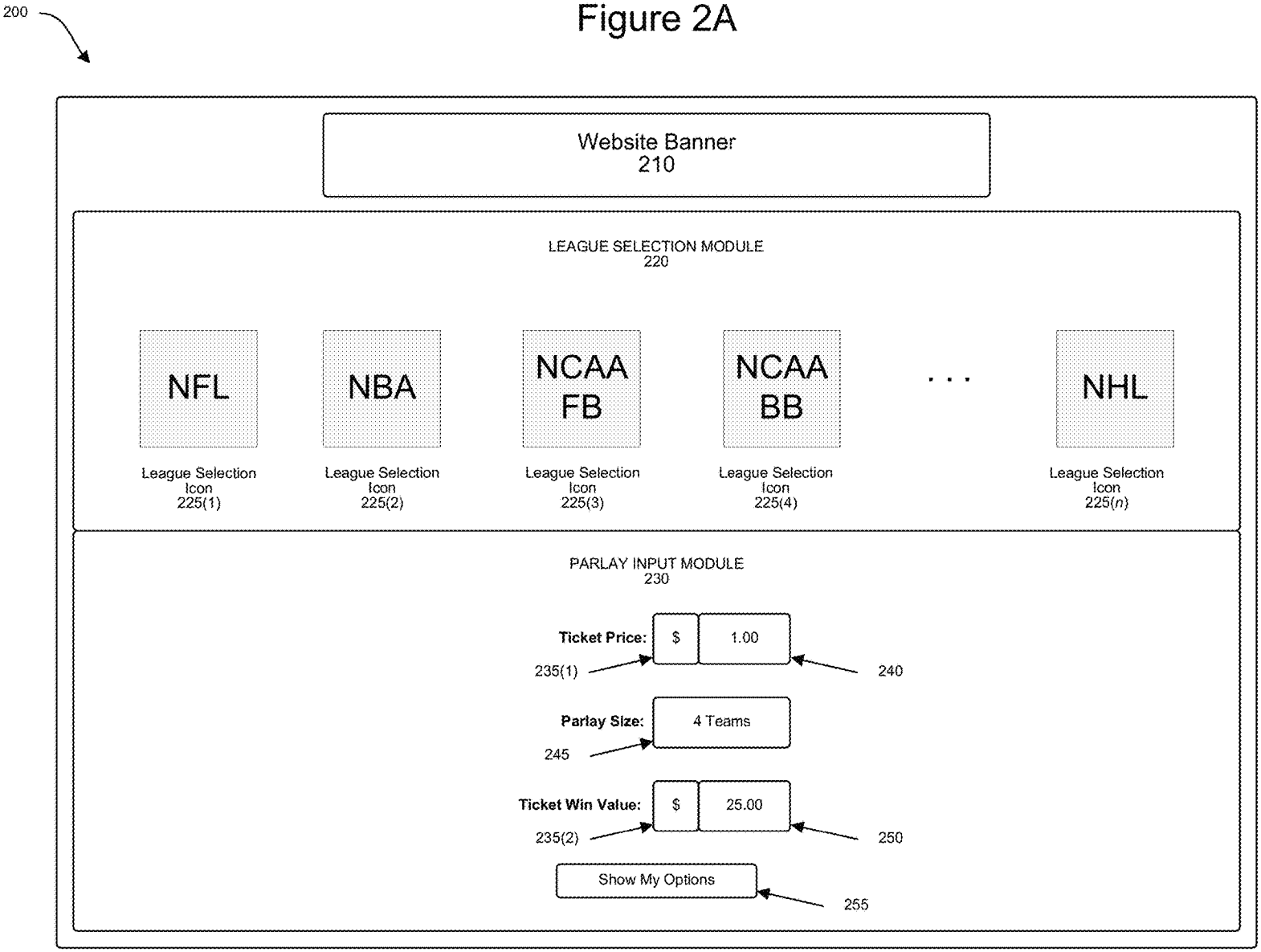
FIG. 2A is a block diagram depicting a first portion of a user interface of a gaming terminal, according to one embodiment of this disclosure.
Figure 2B:
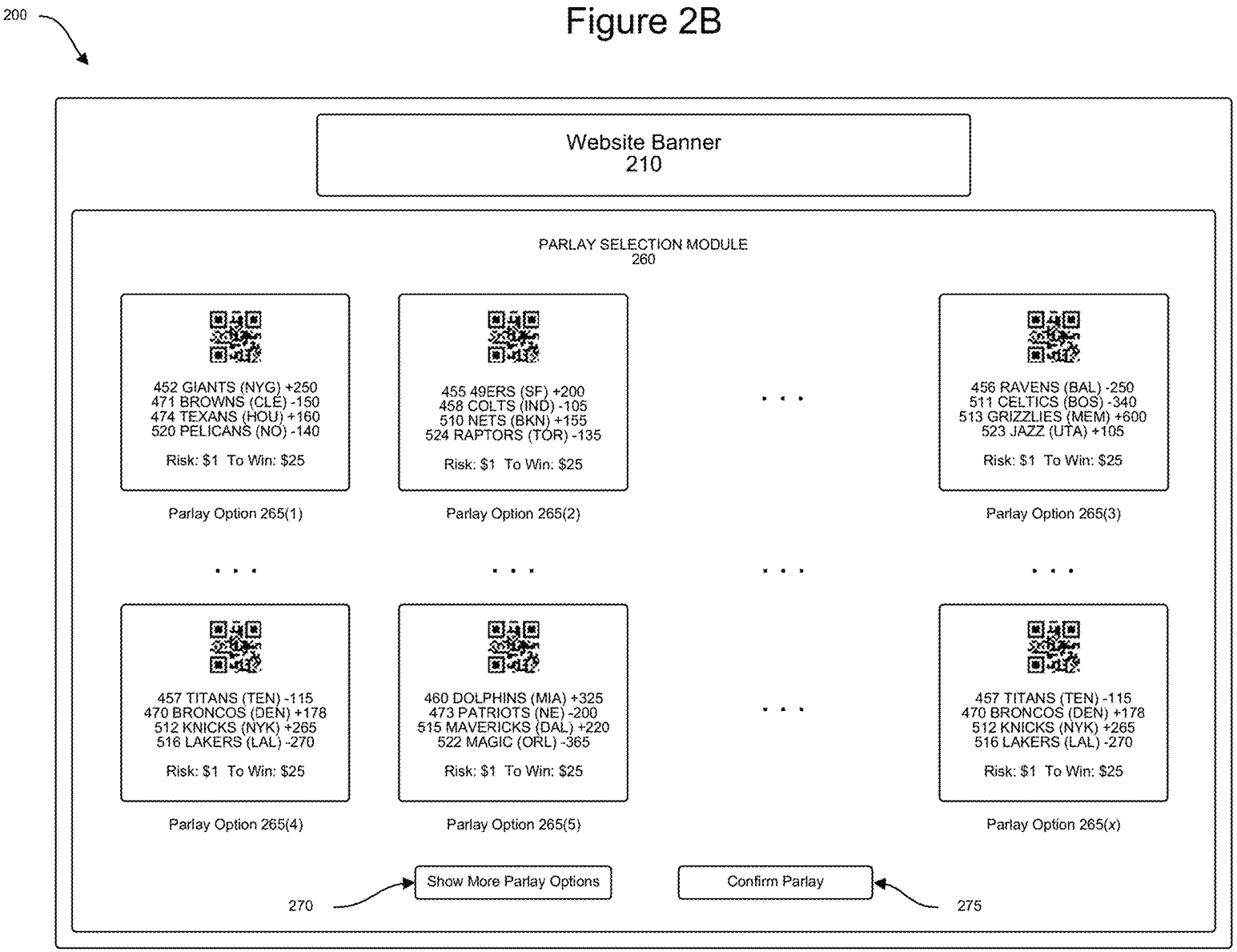
FIG. 2B is a block diagram depicting a second portion of a user interface of a gaming terminal, according to one embodiment of this disclosure.

FIG. 2A illustrates a block diagram of an example of a first portion (e.g., a first screen) of a user interface of a Gaming Terminal, such as Gaming Terminal 110. FIG. 2B likewise illustrates block diagram of an example of a second portion (e.g., screen) of a user interface of a Gaming Terminal, such as Gaming Terminal 110. In certain embodiments, the portion of the user interface shown in FIG. 2A is a screen that can be displayed to collect information such as is shown in FIG. 2A, and the portion of the user interface shown in FIG. 2B is an example of a user interface (or portion thereof) that can be displayed in response to "submitting" (to a server, such as Gaming Server 140) the information collected by the portion of the user interface shown in FIG. 2A. As the reader will appreciate, the example user interface depicted in FIGS. 2A and 2B is being provided primarily for ease of discussion later in this disclosure, and is not intended to be limiting in any manner. Although one specific example of a first portion a user interface and one specific example of a second portion a user interface are shown here, many other screen layouts (and component parts thereof) are possible as well.

Turning to FIG. 2A and the components thereof, FIG. 2A depicts a user interface 200 (e.g., a webpage, or an entry screen on a dedicated terminal) that includes a website banner, such as, e.g., Website Banner 210. Website Banner 210 can include branding information, advertising information, menus, "look and feel" information, and other components of a Graphical User Interface. Website Banner 210 is not directly utilized in performing the functionality described herein, but is provided primarily for ascetic and branding purposes, and is included for completeness in the discussion provided herein.

FIG. 2A also shows League Selection Module 220. As shown in FIG. 2A, League Selection Module 220 includes League Selection Icons 225(1)-225(*n*) (collectively, "League Selection Icon(s) 225"). In the embodiment shown in FIG. 2A, each League Selection Icon 225 represents a sports league that has upcoming events (e.g., games, matches, tournaments, and other events) upon which a wager can be placed. In certain embodiments, the specific League Selection Icons 225 that are displayed at any given time will be based on the sports that are currently in-season. For instance, the NFL and NCAA Football Logos may not be displayed in March, as those sports are not in season at that time. However, different logos (such as, e.g., NCAA Women's Basketball) may be displayed during March, as those sports are very much in-season at that time (and indeed, March is perhaps the busiest time of the year as far as wagering on NCAA Women's basketball is concerned). As such, League Selection Icons 225 representing leagues (or other entities that are not leagues per se, such as, e.g., NASCAR, Formula 1, FIFA, or the Olympics, which will collectively be referred to herein as "leagues") other than the specific leagues represented in FIG. 2A can be shown when those specific leagues are in-season. League Selection Icons 225 can also be used to represent other event categories, e.g., World Events, Weather, or Politics, in addition to leagues. Similarly, any of the leagues represented by League Selection Icons 225 (as shown in FIG. 2A) can be omitted, e.g., if those sports (or other event categories) are out of season at any given time, or if a particular embodiments of an integrated gaming system is designed not to offer wagers a particular league or event category, among other such possibilities. Moreover, although all of the League Selection Icons 225 depicted in FIG. 2A correspond to sporting leagues, in practice, logos (or other representations) of other leagues (or categories of events) can be included as well, such as, e.g., chess, politics, weather, world events, and so forth. In short, any league (or other category of events) upon which a wager can be placed can be depicted as a League Selection Icon 225 (or other representation, such as text, pictures, or a combination thereof). Moreover, although depicted as logos in FIG. 2A for the sake of illustration, in practice, League Selection Icons 225 could be plain text or some other representation of the associated league or category of events.

The purpose of each League Selection Icon 225 is to allow a user (e.g., a customer who wishes to place a wager, or a store clerk who is waiting on such a customer, among other examples) to choose the league or leagues (or event category/categories of events) upon which he or she is interested (or at least potentially interested) in placing a wager, a concept which will be discussed in more detail below. As such, each Gaming Terminal 110 should be configured in a manner that allows a user to select one or more leagues (and/or event categories) that should be included among the one or more Parlay Option(s) that will be presented to him later in this process, a concept which will also be discussed in more detail below. A user may identify the leagues (and/or event categories) that s/he is interested in wagering on by "selecting" the League Selection Icon(s) 225 corresponding to the appropriate leagues (and/or event categories). In various embodiments, this selection can be made by using a mouse (or similar pointing device) to click on the desired League Selection Icon(s) 225, by selecting a "radio button" (or similar input mechanism, such as a check box), and/or by touching the screen of a Gaming Terminal 110 equipped with a touchscreen in order to make the appropriate selection(s), among other means of selecting the desired leagues (and/or event categories).

Although not expressly shown in FIG. 2A, League Selection Module 220 (or another component of user interface 200) can also provide a user with the option to exclude certain bet types from the parlay options that are presented to the user. For instance, perhaps a user may wish to bet on the winner of games in his or her chosen leagues (or other event categories), but may want to avoid betting on "totals" (i.e., the total points scored in a game, which can also be referred to as betting on the "over/under" of the game) and "prop bets" (i.e., propositions, such as, e.g., the number of touchdown passes that a quarterback will throw in a football game, or which team will get the first hit in a baseball game, or even which team will win the coin flip in a football game, among many other such examples). In such a situation, user interface 200 can include an option to "exclude" various bet types, such as, e.g., winners/losers, over/under bets, prop bets, and so forth. In one embodiment, this functionality can be provided via a series of checkboxes, where the user could check the boxes of the bet types that he or she wishes to exclude from his or her parlay options.

FIG. 2A also shows Parlay Input Module 230. In the embodiment shown in FIG. 2A, Parlay Input Module 230 includes currency selection options 235(1)-235(2) (collectively, "currency selection option(s) 235"), a wager amount field 240, a parlay size option 245, a desired payout field 250, and a button (or other mechanism) to submit the information selected and/or entered by the user, such as the button 255 that is labelled "Show My Options" in FIG. 2A. (The reader will appreciate that button 255 can include almost any text desired by the designer of the user interface in a particular implementation, without changing the functionality of button 255, which has the primary purpose of "submitting" the data entered on the current screen to a server, such as Gaming Server 140.) In practice, Parlay Input Module 230 can also be configured to allow a user to select other parameters, such as a "date range" and/or "closing date" during/by which all of the events for which at least one related wager is included in the parlay are to be completed. For instance, a user may desire to purchase a ticket on a Wednesday afternoon but have that ticket include (or at least potentially include) events from later in the day on that same day, as well as events on the coming Thursday, Friday, and Saturday, in which case the closing date could be set to the date of that coming Sunday. In another situation, a user may desire to purchase a ticket on a Monday, but skip events that occur during the week, and instead only cover events that will take place that coming weekend, in which case the date range may be used and the dates appropriately set.

In practice, League Selection Module 220 and Parlay Input Module 230 may be displayed as a single module; or, alternatively, one or both of these modules can be split into two or more smaller components, submodules, and so forth. Moreover, one or more elements that are shown as being part of one of these modules in FIG. 2A may, in practice, be included in the other module, or in another module or component not expressly depicted in FIG. 2A. As the reader will appreciate, although one specific configuration is shown FIG. 2A, primarily for discussion purposes, many other configurations of the first portion of user interface 200 are possible.

Regarding the aforementioned components of the Parlay Input Module 230, one or both of the currency selection options 235 can be used to select the currency the user would like to denominate his wager, such as the U.S. Dollar, the Canadian Dollar, the Euro, the British Pound, Bitcoin (or other cryptocurrencies), and so forth. In certain embodiments (such as, e.g., a system designed to be used specifically in the United States only), this option may be preselected/predetermined and not subject to change by the user. In other embodiments (such as, e.g., a webpage being accessed by a user via the Internet), this option may be available for the user to change as desired, although the available options will typically by limited to a predetermined set of available currencies. In embodiments where this option can be set by a user, either currency selection option 235(1) or currency selection option 235(2) can be used to set the available currency, although currency selection option 235(1) will be referenced herein as the currency selection option 235 that will be used in such situations. Wager amount field 240, which is labeled as "Ticket Price:" in FIG. 2A, can be a text input box, or a prepopulated list of available options (e.g., $1.00, $2.00, $3.00, $4.00, $5.00 . . . , up to a predetermined maximum wager), or other means of input the amount that the user wishes to wager.

Parlay size option 245 will most commonly be a prepopulated list of available options (e.g., 2 teams, 3 teams, 4 teams, . . . 20 teams (or some other maximum value)), in order to prevent the user from repeatedly entering erroneous values. Nevertheless, parlay size option 245 can also take the form of an input text box, among other options that can be used by a user to enter this information. If an input text box is used, a script (or similar functionality) can be employed to confirm that the value entered in the text box is valid. The reader will appreciate that the number of teams (or other events) involved in a parlay must be a positive integer that is greater than or equal to the integer one (1). In certain embodiments, in order to prevent a payout that is overly large and could thus be damaging or even crippling to a person or company offering wagers through the system and methods described herein, the number of teams (or other events) involved in a parlay can be capped at a certain number, such as, e.g., 20. In any situation, parlay size option 245 represents the number of teams that the user would like to include in the parlay upon which s/he is interested in placing a wager.

Moving on to the next line of FIG. 2A, the second instance of currency selection option 235 will typically either be preselected/predetermined and not subject to change by the user, or tied to the option selected by a user in the first instance of currency selection option 235, with both of the foregoing options being designed to ensure that the currency of the wager and the currency of any payout associated with a winning ticket are the same. In practice, however, the second instance of currency selection option 235 does not necessarily have to be tied to the first instance of currency selection option 235, which would allow for the wager amount and payout amount to be specified in different currencies (e.g., a wager in USD that the user desires to have paid out in Bitcoin (or another cryptocurrency), or vice versa). In certain embodiments, the desired payout field 250, which is labeled "Ticket Win Value:" in FIG. 2A, allows the user to enter the amount that s/he desires to win if his/her selected parlay is a winner. In other embodiments, desired payout field 250 can be automatically tied to the values entered on other portions of this form, such as the ticket price and desired parlay size.

In the example screen shown in FIG. 2A, the reader will notice that the wager amount field 240 has been set to $1.00, the parlay size option 245 reflects a desired 4 team parlay, and the desired payout field 250 reflects a desired payout of $25.00 should the user win his or her parlay. As will be explained in more detail this below, this information (as well as information indicating the desired leagues and/or other event categories upon which the user is open to wagering) will be gathered and sent to a server (such as, e.g., Gaming Server 140) when the user presses (or otherwise activates) the submit button 260. After this information is sent to Gaming Server 140, Gaming Server will then return one or more available Parlay Options that satisfy the parameters entered by the user in a screen such as the example user interface shown in FIG. 2A. These available Parlay Options will be discussed in more detail in conjunction with the discussion of FIG. 2B, below.

As noted above, FIG. 2B likewise illustrates block diagram of an example of a second portion (e.g., screen) of a user interface of a Gaming Terminal, such as Gaming Terminal 110. The embodiment shown in FIG. 2B includes Website Banner 210 (which was discussed above), Parlay Selection Module 270, Parlay Options 265(1)-275(*x*) (collectively, "Parlay Option(s) 275"), and buttons 270 and 275 (which are labelled "Show More Parlay Options" and "Confirm Parlay," respectively, in FIG. 2B. In practice, other configurations are possible.

The portion of the user interface shown in FIG. 2B is an example of a user interface (or portion thereof) that can be displayed in response to "submitting" (to a server, such as Gaming Server 140) the information collected by the portion of the user interface shown in FIG. 2A. As will be discussed in more detail below, when a user enters certain information (such as, e.g., the information discussed above and collected in connection with the various components of the example user interface shown in FIG. 2A) and then "submits" that information to a Gaming Server 140, Gaming Server 140 will perform certain calculations (such as, e.g., those shown in FIG. 4 and FIG. 5, and discussed below in connection therewith) to determine one or more Parlay Options (such as, e.g., Parlay Options 265) that are available to the user based on the aforementioned information (or other such information) entered by the user and submitted to the Gaming Server 140.

As shown in FIG. 2B, each Parlay Option 265 includes a number of games (or other events) corresponding to the number of teams indicated in parlay size option 245 as indicated in the information submitted to Gaming Server 140, as is discussed elsewhere herein. (Moreover, as the reader will appreciate, the specific Parlay Options 265 shown in FIG. 2B only include games from the NFL and NBA, and therefore comprise a set of potential Parlay Options 265 that could be provided on a given day in response to a user selecting the NFL and NBA as his or her leagues, such as can be done, e.g., with respect to FIG. 2A.) For instance, in the embodiment shown in FIG. 2A, the reader will notice that parlay size option 245 is set to 4 teams, and that as a result, each Parlay Option 265 shown in FIG. 2B includes exactly 4 teams. (The reader will also appreciate that, while the term "team(s)" is being used for the sake of the discussion provided herein, in practice, each parlay option can be an individual (e.g., a tennis player or golfer), a "side" (such as, e.g., in soccer), or the potential outcome of an event (e.g., the political party that will control the U.S. House of Representatives following the next General Election), among other such options. As such, the term "team" is not meant to be limited to "teams" in the strictest sense of the word.)

The reader will also notice that each team (or even outcome) includes information identifying the event itself, the event outcome (e.g., team that will win; whether the total points scored will be "over" or "under" the "total"; and the results of various proposition bets such as, e.g., which team will win the pregame coin flip, or which political party will control the U.S. House of Representatives following the next general election; among many other options), and the moneyline (or a point spread or other information that can be converted to a moneyline) associated with that event outcome. Regarding the first of these items, the information identifying the event itself can take the form of a number (e.g., the numbers 452, 471, 474, 520, and so forth), and can be configured to indicate either a specific event (e.g., the number 452 could be used to reference a game between the New York Giants and another NFL team on a certain date) or to indicate a team involved in an event (e.g., the number 452 could be used to reference the New York Giants, with respect to their game against another NFL team on a certain date, with a different number, such as 453, for example, being used to reference the other NFL team involved in that same game) or a specific outcome of an event (e.g., a certain number could be used to reference the total points scored in a game going "over" the "total," and a different number could be used to reference the total points scored in that same game being "under" the "total"). Other options are possible here as well, although the screen should preferably make clear the specific event outcome that is being wagered upon. Of course the team (or other selected outcome) of that game (or event) should also be specified, as is shown in FIG. 2B by the use of team names such as, e.g., Giants (NYG), Browns (CLE), Texans (HOU), Pelicans (NO), and so forth, which respectively are references to the New York Giants (NFL Football), Cleveland Browns (NFL Football), Houston Texans (NFL Football), and New Orleans Pelicans (NBA Basketball).

Each Parlay Option 275 should also include the moneyline (or a point spread or other information that can be converted to a moneyline) associated with the particular outcome shown. In certain embodiments, a moneyline can be either a positive number that is greater than or equal to 100, or a negative number that is less than or equal to −100. In other embodiments, however, a moneyline may be expressed in other ways. For instance, the moneyline associated with the Giants winning the first game shown in FIG. 2B is +250. This means that a person wagering on this game in its individual capacity would only have to risk $100 to win $250. Since a bettor has to risk less than s/he would win on a successful outcome, the bettor can conclude that the Giants are the underdogs in this game. Conversely, if the moneyline is a negative number (e.g., the Browns are −150 in the second game of the first Parlay Option 265 shown in FIG. 2B), then in order for a person wagering on this game in its individual capacity to win $100, that person would have to risk the absolute value of the moneyline (e.g., $150).

As such, since a bettor has to risk more than s/he would win on a successful outcome, the bettor can conclude that the team being wagered on in that situation is the favorite.

Also shown in FIG. 2B, each Parlay Option 265 can optionally include a QR code. Although generic (and therefore, identical) QR codes are included in FIG. 2B for the sake of illustration, in practice, each QR code would be uniquely tied to the specific Parlay Option 265 with which the respective QR code is included. In other embodiments, other options can be used in place of a QR code. For instance, radio button, check box, or a number associated with the specific Parlay Option 265 can be used as well. Regardless of which specific mechanism (e.g., a QR code, radio button, check box, number, etc.) is used to identify the Parlay Option 265, the general purpose of this feature is to allow a user to select the Parlay Option(s) that s/he is interested in wagering upon. As such, and depending in part on the specific configuration of a given Gaming Terminal 110, certain embodiments enable a user to select one or more Parlay Options 265 by "clicking" on the relevant Parlay Option(s) 265 (e.g., with a mouse, trackpad, or other computer pointing device), "touching" the relevant Parlay Option(s) 265 (e.g., with a finger, stylus, and so forth, particularly if the Gaming Terminal 110 in use is configured with a touchscreen that allows for such inputs), scanning the QR code, or even using voice commands to identify the desired Parlay Option(s) 265.

If the user is interested in placing a wager on any Parlay Option 265 listed on this screen, the user can select one or more of those Parlay Options 265, such as in one of the manners described above. If the user is not interested in placing a wager on any Parlay Option 265 listed on this screen, or the user simply wants to see more Parlay Options 265, the user may press, "click" on, or otherwise select, etc. a button (such as, e.g., button 270) that allows the user to see one or more additional Parlay Option(s) 265 that satisfy the parlay parameters (e.g., league(s) and/or event category/categories of interest, wager amount (e.g., ticket price), parlay size, desired payout (e.g., ticket win value), and so forth) that the user entered on the previous screen. In such a situation, the Gaming Terminal 110 being used can convey this information to Gaming Server 140, and Gaming Server 140 can then respond with another group of one more additional Parlay Options 265, which Gaming Server 140 can then display for the user to select among (and/or to request yet another group of Parlay Options 265). In other embodiments, Gaming Server 140 can send along (as part of the first request, e.g., when the user presses button 255 on the previous screen) more Parlay Options 265 than are to be displayed at any one time (such as on a screen such as the example shown in FIG. 2B), in which case Gaming Terminal 110 can store those extra Parlay Options 265 in memory when they are first received, and then access that memory (without sending another request to Gaming Server 140) to determine what other Parlay Options 265 are available to the user. In either situation, the necessary information (e.g., the parlay parameter information entered in conjunction with FIG. 2A and/or the extra Parlay Options 265) can be stored in a memory on the Gaming Terminal 110 being used, and can be tracked by using cookies, sessions, query strings, or other such functionality.

Once the user has made his or her selections among the available Parlay Option(s) 265, the user can then select, press, or "click" on (and so forth) button 275 to "confirm" and/or otherwise submit his or her selections. As such, button 275 is similar to button 255 in functionality. Once the user selects, presses, or "clicks" on (and so forth) this button, the gaming system can optionally submit the selected Parlay Option(s) 265 to Gaming Server 140, which can then perform a final round of validation (and record information related to the wager) on the selected Parlay Option(s) 265 before sending a confirmation back to the Gaming Terminal 110 that the selected Parlay Option(s) 265 have been approved. (This final confirmation and validation step will be discussed in more detail below, but in general can include functionality such as determining that the odds provided for each game/event are still valid, and/or determining that aggregate risk parameters associated with any selected Parlay Option 265 (and/or the outcome(s) of any events included therein) have not been exceeded across the entire system, such as, e.g., integrated gaming system 100.) In other embodiments, this final confirmation and validation step can be skipped, although the information related to the wager itself should still be recorded. The system can then provide a printed "ticket" (or other physical or electronic record) that includes the relevant information related to the specific Parlay Option(s) that the user selected. The ticket can also include the QR code (or other such information, as discussed above), which in this case can be used to allow the user to easily check the results of his or her parlay(s).

The reader will also notice that each Parlay Option 265 depicted in FIG. 2B includes information indicating the wager ("Risk") and payout ("To Win") amounts associated with the associated Parlay Option 265. In this instance, the reader will appreciate that the wager and payout values associated with each Parlay Option 265 shown in FIG. 2B are not only identical to each other, but also identical to the user's parlay parameters as shown in FIG. 2A. In practice, however, the integrated gaming system may be configured to display one or more parlay options that contain wager and/or payout values that are fairly similar to the user's specified parlay parameters, but yet not identical to the user's specified parlay parameters. This situation could occur in a variety of scenarios, such as, e.g., when the user's specified parlay parameters result in only a relatively low number of games (or other events) being available for consideration, and/or when the user's specified parlay parameters include relatively extreme values for the user's desired wager and payout, among other possibilities. Regardless of the particular reason why, in certain embodiments it may be desirable for the integrated gaming system to display Parlay Options 265 that meaningfully deviate from the user's specified risk and payout values, in which case the actual odds being offered in conjunction with a given Parlay Option 265 can be displayed within the Parlay Option 265, such as, e.g., in the manner depicted in FIG. 2B.

Figure 3:
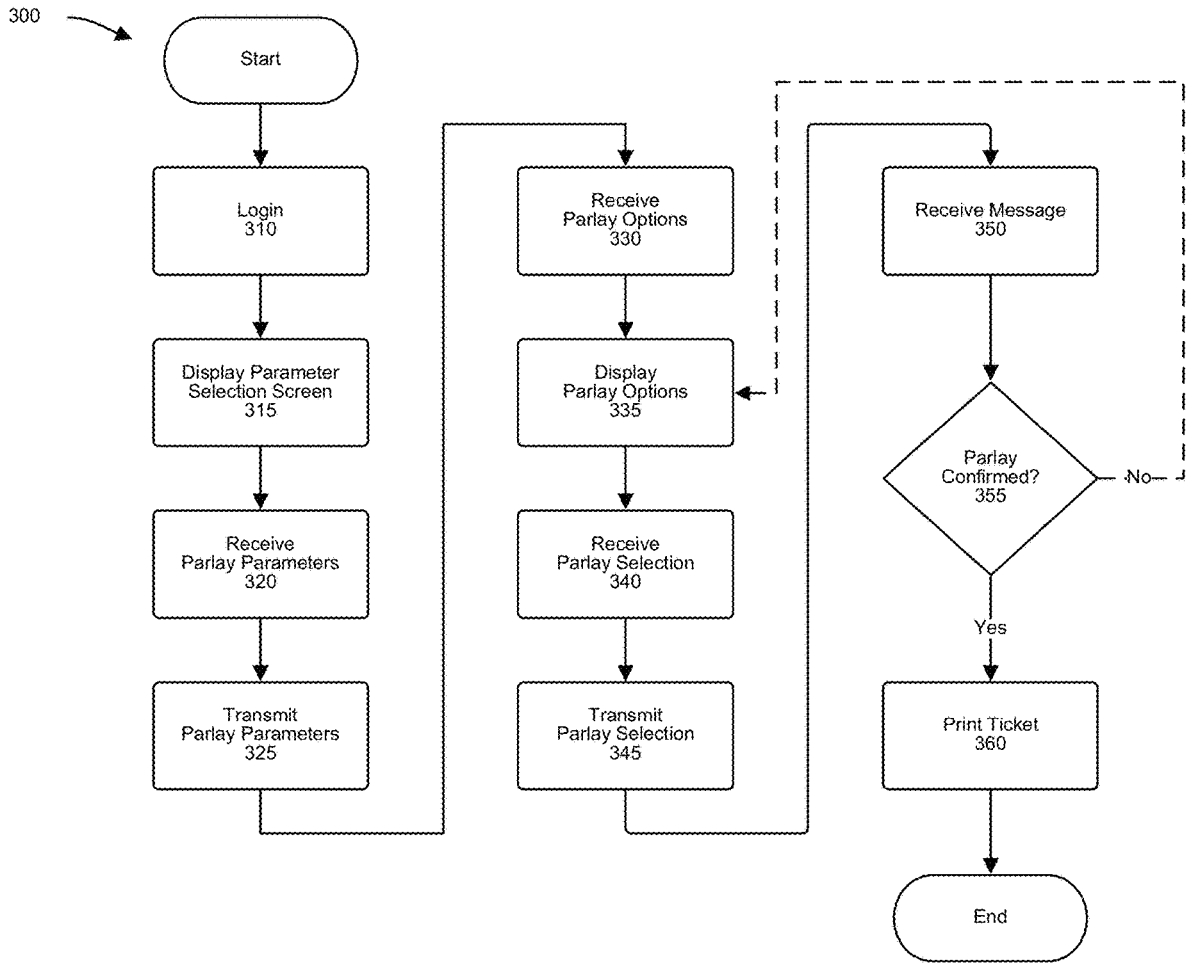
FIG. 3 is a flowchart for performing various steps of a process to select a parlay option upon which to place a wager, according to one embodiment of this disclosure.
Figure 4:
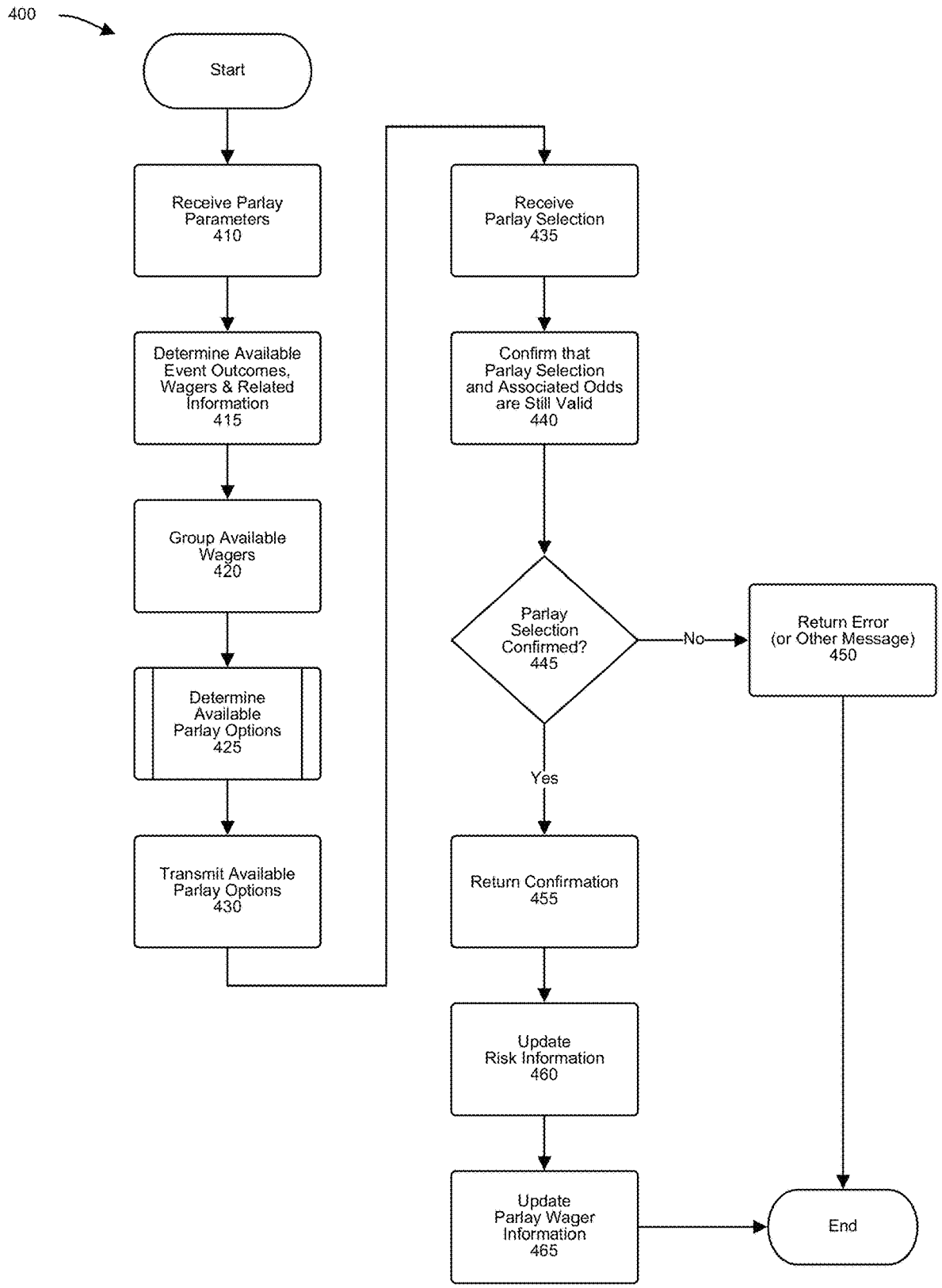
FIG. 4 is a flowchart for performing various steps of a process to determine and return available parlay options upon which a wager may be placed, and to validate a parlay selection, according to one embodiment of this disclosure.
Figure 5:
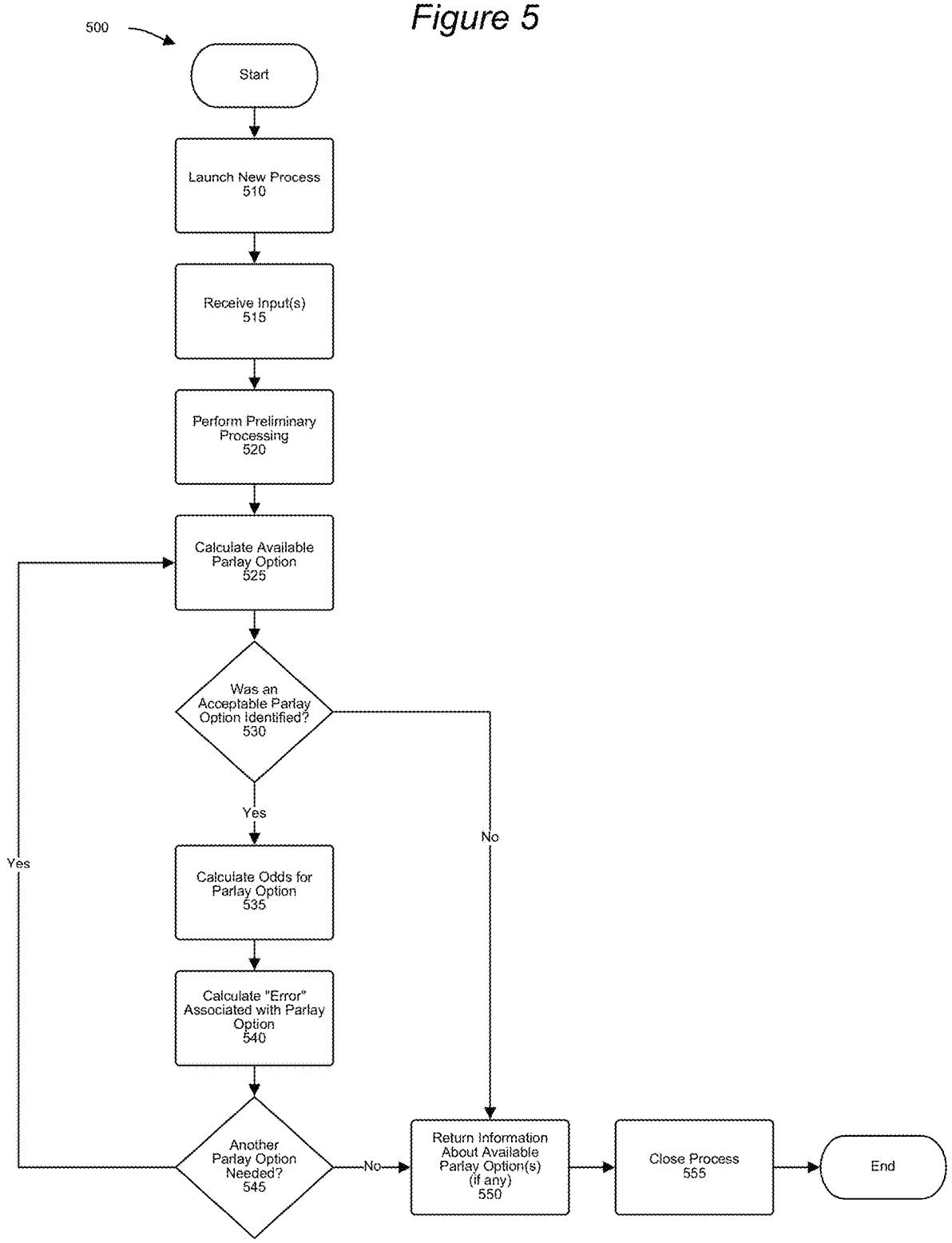
FIG. 5 is a flowchart for performing various steps of a process to determine available parlay options upon which a wager may be placed, according to one embodiment of this disclosure.

Moving on to FIGS. 3-5, FIG. 3 illustrate various actions that can be performed in conjunction with this disclosure, such as can generally be viewed, e.g., from the perspective of a Gaming Terminal 110. FIG. 4 and FIG. 5, which will be discussed below, illustrate various actions that can be performed in conjunction with this disclosure, such as can generally be viewed, e.g., from the perspective of a Gaming Server 140. As will also be appreciated in light of the present disclosure, each of these methods may be modified in order to derive alternative embodiments. Moreover, although the steps in the embodiments of these methods that are discussed herein are shown in a sequential order, certain steps may occur in a different order than shown, certain steps may be performed concurrently, certain steps may be combined with other steps, and certain steps may be omitted in another embodiment. For discussion purposes, methods 300, 400, and 500 are described with reference to elements such as those described in connection with FIGS. 1A, 1B, 2A, and 2B, as described above, although other models, frameworks, systems, and environments may be used to implement these processes. In the flow diagram included in each of these figures, each block represents one or more operations that can be implemented in hardware, software, or a combination thereof. In the context of software, the blocks represent computer-executable instructions that, when executed by one or more processors, cause the processors to perform the recited operations. Generally, computer-executable instructions include routines, programs, objects, modules, components, data structures, and the like that perform particular functions or implement particular abstract data types. The order in which the blocks are described is not intended to be construed as a limitation, and any number of the described operations can be combined in any order and/or in parallel to implement the processes.

Turning now to FIG. 3, FIG. 3 is a flowchart of a method 300 illustrating various actions performed in connection with certain embodiments of the systems and techniques disclosed herein. To provide more detail, FIG. 3 is a flowchart of a process 300 that may be performed by a computing device (such as, e.g., any Gaming Terminal 110) as described herein, and process 300 may also be performed in conjunction with one or more steps of one or more other processes described herein, such as, e.g., methods 400 and 500.

In certain embodiments, method 300 begins at 310, where a user can login. In certain embodiments, this step can be used when a user is accessing a Gaming Terminal 110 via the Internet (such as, e.g., via a webpage accessed on a personal computing device), as could be the case if a user wanted to place a wager from his or her home, vehicle, restaurant, or any other location where a dedicated Gaming Terminal 110 is not present. In another embodiment, this step can be performed by a clerk in a store where a dedicated Gaming Terminal 110 is present, such as a store that sells parlay tickets in conjunction with this disclosure. In other embodiments, a Gaming Terminal 110 can be configured to automatically identify itself when it joins a network (such as, e.g., network 130) as part of an integrating gaming system such as is described herein (such as, e.g., integrated gaming system 100). In still other embodiments, this step can be skipped entirely.

At 315, method 300 displays a parameter selection screen, such as, e.g., the first screen of the example user interface shown in FIG. 2A and discussed herein in conjunction therewith. As noted above, a parameter selection screen can include various fields and other inputs for a user to enter and/or otherwise select, such as, e.g., one or more League Selection Icon(s) 225 (which, of course and as described in more detail above, can also represent event categories or organizations that are not "leagues" per se), one or more currency selection option(s) 235, a wager amount field 240, a parlay size option 245, and a desired payout field 250, as well as other information that may be relevant to the functionality disclosed herein, such as a date range, a closing date, and/or other date and time information. A user can then enter this information, which is referred to for the purposes of the discussion herein as the user's "parlay parameters," or simply, the "parlay parameters." Method 300 receives these parlay parameters (such as, e.g., when the user enters this information into a Gaming Terminal 110) in 320.

After the user's parlay parameters have been entered and the user submits those parlay parameters (such as, e.g., upon the user pressing, clicking, or otherwise selecting a button (such as, e.g., button 255) to submit the parlay parameters), method 300 then transmits the parlay parameters (such as, e.g., to Gaming Server 140) in 325. Although not expressly shown in FIG. 3, in certain embodiments, method 300 can perform one or more client-side, preliminary validation steps prior to transmitting the parlay parameters, such as verifying that a valid currency was entered, that the wager amount is a positive (and otherwise acceptable) number, that the parlay size is a positive integer that is greater than or equal to the integer one (1), that the desired payout (e.g., ticket win value) is a positive integer (and perhaps within a certain range, relative to the wager amount), that any entered dates or date ranges are valid (and otherwise within reason, e.g., perhaps with the next week, or 30 days, or 90 days, as appropriate), and so forth. In other embodiments, the parlay parameters received in 320 can be validated as they are entered, so that most (and in certain embodiments, all) of the desired client-side validation has been completed prior to the user "submitting" (such as, e.g., by pressing a button such as button 255) his or her parlay parameters. In other embodiments, the parlay parameters received in 320 can be transmitted in 325 without performing any client-side validation. In certain embodiments, if a Gaming Terminal 110 is configured to perform one or more steps of methods 400 and/or 500, Gaming Terminal 110 can process the parlay parameters internally without necessarily having to transmit the information to a Gaming Server 140 (or any other device). Nevertheless, for the sake of logical consistency and ease of explanation, this discussion herein will proceed under the assumption that the user's parlay parameters are indeed transmitted (to a Gaming Server 140, or similar device) in 325.

At this point, an entity (such as, e.g., Gaming Server 140, Parlay Selection Module 143, and/or an internal process of Gaming Terminal 110, among other options) configured to perform one or more steps of method 400 and/or 500 can perform one or more steps of method 400 and/or 500, which will be discussed in more detail below, in order to determine one or more available Parlay Options, such as, e.g., Parlay Options 265. The entity that performs these steps can transmit (or otherwise return) the available Parlay Option(s) (or information sufficient to identify the available Parlay Option(s), or other such information) back to the entity (e.g., Gaming Terminal 110) that transmitted the parlay parameters in 325. The available Parlay Option(s) 265 (or information sufficient to identify the available Parlay Option(s), or other such information) are received (such as, e.g., by the Gaming Terminal 110 that transmitted the user's parlay parameters in 325) in 330. As the reader will appreciate, a user is unlikely to be willing to wait a long time to receive his or her Parlay Option(s) 265 (or to have those Parlay Option(s) 265 otherwise determined) after submitting his or her parlay parameters. As such, the time between steps 325 and 330 must be much faster than any person (or group of people) could possibly determine the Parlay Option(s) 265 that satisfy the user's parlay parameters if such determination were to be performed by "pen and paper," so to speak. Indeed, in certain embodiments, the time that elapses between steps 325 and 330 is less than one second. In other embodiments, the time that elapses between steps 325 and 330 can be slightly longer, but still very short (and within the bounds of a modern user's attention span), and, in various embodiments, can be less than one minute, less than 30 seconds, less than 20 seconds, less than 10 seconds, less than 5 seconds, less than 4 seconds, less than 3 seconds, or less than 2 seconds.

Upon receiving the available Parlay Option(s) 265 (or information sufficient to identify the available Parlay Option(s), or other such information) in 330, method 300 then displays the available Parlay Option(s) 265 (or a subset thereof) in 335. In certain embodiments, the available Parlay Option(s) 265 can be displayed in the manner shown in FIG. 2B, or in a similar manner In other embodiments, the available Parlay Option(s) 265 can be displayed in a different manner, including, but not limited to, the various alternatives provided in the discussion accompanying FIG. 2B. In certain embodiments, and as will be discussed in more detail in conjunction with FIG. 5 and method 500 below, information regarding the actual probability associated with each Parlay Option 265, and/or the odds that the system is actually offering with respect to each Parlay Option 265, can be displayed as part of (or in conjunction with) each Parlay Option 265. As shown in FIG. 2B, each Parlay Option 265 can also include a QR code, and in other embodiments, each Parlay Option 265 can alternatively or additionally also include a serial number or other unique identifier. And of course, each Parlay Option 265 should include information identifying each event outcome included in the Parlay Option, and the associated moneyline (or a point spread or other information that can be converted to a moneyline) associated with each event outcome included in the Parlay Option. As can be seen in FIG. 2B, each Parlay Option 265 can optionally include both a number (or other alphanumeric character sequence) that uniquely identifies each event outcome included in the Parlay Option (such as, e.g., 452, 471, 474, and 520, in example Parlay Option 265(1)), as well as a more descriptive label for each such event outcome included in the Parlay Option (such as, e.g., GIANTS (NYG), BROWNS (CLE), TEXANS (HOU), and PELICANS (NO), also as seen in example Parlay Option 265(1)).

As was the case with the time that is allowed to elapse between steps 325 and 330, the reader will appreciate that the user's desire is for the available Parlay Option(s) 265 to actually be displayed to him or her—not just for the Gaming Terminal 110 (or similar device) to receive (or determine) the available Parlay Option(s) 265. As such, the time between steps 325 through 335 must be much faster than any person (or group of people) could possibly determine and then display the available Parlay Option(s) that satisfy the user's parlay parameters if such determination and display were to be performed by "pen and paper," so to speak. Indeed, in certain embodiments, the time that elapses between steps 325 through 335 is less than one second. In other embodiments, the time that elapses between steps 325 through 335 can be slightly longer, but still very short (and within the bounds of a modern user's attention span), and, in various embodiments, can be less than one minute, less than 30 seconds, less than 20 seconds, less than 10 seconds, less than 5 seconds, less than 4 seconds, less than 3 seconds, or less than 2 seconds.

After displaying the available Parlay Option(s) 265 in 335, method 300 then receives a user's parlay selection(s) (e.g., his or her selection of one or more Parlay Options upon which the user would like to wager) in 340. The user's parlay selection(s) can be inputted (such as to Gaming Terminal 110) in any of the various manners described above, such as, for example and not limited to any of the following: scanning a QR code, selecting a radio button or check box, entering a number associated with a specific Parlay Option 265, "clicking" on the relevant Parlay Option(s) 265, "touching" the relevant Parlay Option(s) 265 (such as, e.g., on a Gaming Terminal 110 equipped with a touchscreen), and so forth. In other situations, and as described in more detail above, a user may also choose to see other Parlay Option(s) 265 before making his or her selection. And in still other situations, the user may also choose to select one or more Parlay Option(s) 265 that are displayed on one screen, and then also choose to see additional Parlay Option(s) 265 from which s/he may add to his or her selection. In any situation, once the user enters his selection of Parlay Option(s) 265, the user's selection(s) is/are received in 340 and is/are transmitted (such as, e.g., to Gaming Server 140) or otherwise submitted (such as, e.g., to an internal process of Gaming Terminal 110) in 345.

At this point, an entity (such as, e.g., Gaming Server 140, Parlay Selection Module 143, and/or an internal process of Gaming Terminal 110, among other options) configured to perform one or more steps of method 400 and/or 500 can perform one or more steps of method 400 and/or 500, which will be discussed in more detail below, in order to validate and/or otherwise confirm that the selected Parlay Option(s) 265 are still valid. For instance, and as will be discussed in more detail below, the entity performing these steps can confirm and/or verify that the odds provided for each event outcome are still valid, and/or determine that aggregate risk parameters associated with any selected Parlay Option 265 (and/or the event outcomes included therein) have not been exceeded across the entire system, such as, e.g., integrated gaming system 100. As will be discussed in more detail in conjunction with FIG. 4 and method 400, this confirmation and/or validation step will result in method 400 returning either an error message or a confirmation message back to method 300.

Method 300 will then receive this message (e.g., a confirmation/validation message, or an error message, as appropriate) at 350, where such message will indicate either that the selected Parlay Option(s) 265 is/are still valid (in the case where a confirmation message is received), or that some sort of error has occurred (in the case where an error message is received). In certain embodiments, this message is received from Gaming Server 140. In other embodiments, this message is received from one or more processes internal to Gaming Terminal 110. In other embodiments, this message can be received from another component of an integrated gaming system, such as, e.g., integrated gaming system 100.

As the reader will again appreciate, a user is unlikely to be willing to wait a long time to receive a confirmation (or to have his selection of Parlay Option(s) 265 otherwise validated and/or confirmed) after submitting his or her Parlay Option(s) 265. As such, the time between steps 345 and 350 must be much faster than any person (or group of people) could possibly verify and/or confirm the validity of the selected Parlay Option(s) 265 if such actions were to be performed by "pen and paper," so to speak. Indeed, in certain embodiments, the time that elapses between steps 345 and 350 is less than one second. In other embodiments, the time that elapses between steps 345 and 350 can be slightly longer, but still very short (and within the bounds of a modern user's attention span), and, in various embodiments, can be less than one minute, less than 30 seconds, less than 20 seconds, less than 10 seconds, less than 5 seconds, less than 4 seconds, less than 3 seconds, or less than 2 seconds.

At 355, method 300 analyzes the message received in 350 to determine whether the user's selected Parlay Option(s) have been confirmed, or whether an error has occurred. If the message indicates that one or more of the user's selected Parlay Option(s) have not been confirmed (e.g., if an error message was received in 350), method 300 can optionally display an error message (or other informative message), and then return to 335 for the user to select one or more additional Parlay Option(s) that are not subject to the error indicated in the message received in 350. The reader will appreciate that, in this pass through 335 and subsequent steps of method 300, any Parlay Option(s) that were subject to error (as indicated in the error message received in 350) will either be removed from the available Parlay Option(s) 265 that are displayed in this instance of 335, or will be amended (such as, e.g., to reflect revised odds or other information) prior to being display to the user in this instance of 335. If the message indicates that all of the user's Parlay Option(s) 265 have been confirmed, then method 300 proceeds to 360, where method 300 prints, displays, or otherwise provides a printed "ticket" (or other physical or electronic record) that includes the relevant information related to the specific Parlay Option(s) 265 that the user selected. In yet another embodiment, if some (but not all) of the user's selected Parlay Option(s) 265 are confirmed, but one or more of the user's selected Parlay Option(s) are not confirmed, the user may be given an option of how to proceed. For instance, in such a situation, the user may choose to accept the Parlay Option(s) 265 that were confirmed and proceed directly to 360. The user may alternatively choose to return to 335 and re-select his or her Parlay Option(s) without presently accepting the Parlay Option(s) 265 that were confirmed. In other embodiments, other alternatives are possible at this point. In still other embodiments, steps 350 and 355 can be skipped, although the information related to any Parlay Option upon which a wager was placed should still be recorded and step 360 should still be performed.

As the reader will again appreciate, a user is unlikely to be willing to wait a long time to receive a confirmation (or to have his selection of Parlay Option(s) 265 otherwise validated and/or confirmed) and for either remedial measures to be performed (such as, e.g., in the case where an error message is received in 350) or for the ticket to be printed in 360—not just for the Gaming Terminal 110 (or similar device) to receive (or determine) the confirmation message or error message. As such, the time between steps 345 through 360 (if a confirmation message is received in 350) or the time between steps 345, 350, 355, and the second pass through 335 (if an error message is received in 350) must be much faster than any person (or group of people) could possibly determine and then display the available Parlay Option(s) 265 that satisfy the user's parlay parameters if such determination and display were to be performed by "pen and paper," so to speak. Indeed, in certain embodiments, the time that elapses between the aforementioned steps (in either path through method 300) is less than one second. In other embodiments, the time that elapses between the aforementioned steps (in either path through method 300) can be slightly longer, but still very short (and within the bounds of a modern user's attention span), and, in various embodiments, can be less than one minute, less than 30 seconds, less than 20 seconds, less than 10 seconds, less than 5 seconds, less than 4 seconds, less than 3 seconds, or less than 2 seconds.

Turning next to FIG. 4, FIG. 4 is a flowchart of a method 400 illustrating various actions performed in connection with certain embodiments of the systems and techniques disclosed herein. To provide more detail, FIG. 4 is a flowchart of a process 400 that may be performed by a computing device (such as, e.g., Gaming Server 140, or a Gaming Terminal 110 that is configured to perform one or more steps of method 400 and/or method 500) as described herein, and process 400 may also be performed in conjunction with one or more steps of one or more other processes described herein, such as methods 300 and 500.

In certain embodiments, method 400 begins at 410, where the method receives one or more parlay parameters, such as, e.g., the parlay parameters that were received by a Gaming Terminal 110 in 320 and transmitted (or otherwise submitted for processing) by that Gaming Terminal 110 in 325. As discussed above, these parlay parameters can include various fields of information and other inputs, such as, e.g., one or more selected leagues (or other event categories), one or more selected currencies, a wager amount, a parlay size, and a desired payout, as well as other information that may be relevant to the functionality disclosed herein, such as a date range, a closing date, and/or other date and time information. This information is collectively referred to herein as the user's "parlay parameters," or simply, the "parlay parameters."

At 415, method 400 determines the event outcomes and the moneyline (or a point spread or other information that can be converted to a moneyline) associated with each such event outcome and various other information related thereto (such as, e.g., date, time, and so forth) that are available for potential inclusion in the user's Parlay Option(s) 265, which are determined later in method 400 and in conjunction with method 500. In certain embodiments, determining the available event outcomes and moneyline (or a point spread or other information that can be converted to a moneyline) associated with each such event outcome, and related information is based, at least in part, on the user's parlay's parameters. For instance, if the user indicates that s/he is interested in potentially wagering on NFL games and NCAA college football games that take place on a given weekend, then the available event outcomes and the moneyline (or a point spread or other information that can be converted to a moneyline) associated with each such event outcome, and related information pertaining to those parlay parameters can include all of the events (e.g., a Texas vs. Oklahoma college football game) and event outcomes (such as, e.g., Texas winning, Oklahoma winning, the total going "over," the total being "under," Texas scoring first, Texas scoring last, Cameron "Dicker the Kicker" Dicker converting more than 2.5 field goals, and so forth) for which wagering information is available, and the moneyline (or a point spread or other information that can be converted to a moneyline) related to each such event outcome, for each of the NFL games and NCAA college football games that are scheduled to take place on that weekend (or whatever other date or date range was specified in the parlay parameters, for example). However, the available event outcomes and the moneyline (or a point spread or other information that can be converted to a moneyline) associated with each such event outcome, and related information preferably should not include any event outcomes or moneylines (or point spreads or other information that can be converted to a moneyline), and so forth, related to any leagues (or other event categories) that the user did not select as part of his or her parlay parameters. For instance, if the user only selected NFL games and NCAA college football games as part of his or her parlay parameters, then the available event outcomes and moneylines (or point spreads or other information that can be converted to a moneyline), and related information determined in 415 preferably should not include any event outcomes or moneylines (or point spreads or other information that can be converted to a moneyline), and related information related to soccer, MLB, or NASCAR, for instance. In certain embodiments, method 400 pulls this information for a separate website or server, such as, e.g., Odds Server 150. In other embodiment, method 400 determines this information via an internal process. In certain embodiments, the moneylines that are retrieved (such as, e.g., from Odds Server 150) or determined (such as, e.g., by an internal process) may reflect the "consensus probability" or "market probability" of an event outcome occurring, prior to factoring in any "juice" or "vig" that the operator of the integrated gaming system desires to include in any Parlay Option(s) 265 that are offered to a user. Such a moneyline can be referred to as a "zero juice moneyline." When such zero juice moneylines are used, the method can convert the zero juice moneyline to the moneyline that will ultimately be offered to the user (such as, as part of a Parlay Option 265), and which can be referred to as an "offered moneyline." In other embodiments, the integrated gaming system operator's edge (e.g., the "juice" or "vig") may have already been factored into the moneylines that were retrieved at this point, in which case the integrated gaming system operator's edge would not have to be factored in a second time, and the retrieved moneyline can be used as is.

In 420, method 400 "groups" all of the event outcomes for which wagering information is available (such as, e.g., Texas winning, Oklahoma winning, the total going "over," the total being "under," and so forth) for a single game (e.g., Texas vs. Oklahoma) and assigns each such group a unique Group ID. As such, there will generally be one Group ID assigned to each event, and all event outcomes related to that event will share that same Group ID. This Group ID can then be passed to the functionality that determines the available Parlay Option(s) 265 (e.g., the module(s) that perform one or more of 425 and/or method 500) to be used in the computations performed thereby. The manner in which this grouping information is used will be discussed in more detail in conjunction with 425 and method 500, below.

In 425, one or more available Parlay Options 265 that satisfy the user's parlay parameters are determined In certain embodiments, these Parlay Options 265 are determined directly by the component performing method 400, such as would be the case, e.g., in the example integrated gaming system shown in FIG. 1A. In other embodiments, the component performing method 400 transmits information to a component configured to perform method 500, and the component configured to perform 500 performs the majority of the necessary computations and then passes back to the component performing method 400 information that is sufficient for the component performing method 400 to identify the Parlay Option(s) 265 (including the component wagers of each such Parlay Option 265) that were determined by the component performing method 500, which is the general scenario that would occur, e.g., in the example integrated gaming system shown in FIG. 1B.

The functionality of 425 can take various "inputs" (such as, e.g., inputs or other parameters passed to a method call), such as, e.g., the user's parlay parameters received in 410; the available event outcomes and the moneylines (or a point spread or other information that can be converted to a moneyline) that are to be offered (the "offered moneylines") in association with each such event outcome, and related information determined in 415; and the grouping information determined in 420. Method 500, which will be discussed in more detail below, then uses these inputs, at least in part, to determine one or more available Parlay Option(s) 265 (such as, e.g., one or more Parlay Option(s) 265) that satisfy the parlay parameters received in 410 and that do not otherwise exceed any of the integrated gaming system's group constraints or risk control parameters, which will be discussed in more detail below.

Although not expressly shown in FIG. 4, in certain embodiments, method 400 can also perform one or more server-side, preliminary validation steps prior to, or as part of, determining the available Parlay Option(s) 265 in 425. Such validation may include verifying that a valid currency was entered, that the wager amount is a positive (and otherwise acceptable) number, that the parlay size is a positive integer that is greater than or equal to the integer one (1), that the desired payout value is a positive integer (and perhaps within a certain range, relative to the wager amount), that any entered dates are valid (and otherwise within reason, e.g., perhaps with the next week, or 30 days, or 90 days, as appropriate), and so forth. In other embodiments, method 400 can determine what Parlay Option(s) 265 that fit the parlay parameters received in 410 without performing any server-side validation (e.g., in a situation where the Gaming Terminal 110 that transmitted the parlay parameters performed client-side validation checking prior to transmitting the parlay parameters). Once the available Parlay Option(s) 265 (or at least a first group of available Parlay Option 265) have been determined, method 400 then transmits or otherwise returns (such as, e.g., to the Gaming Terminal 110 from which the parlay parameters came) the available Parlay Option(s) 265 (or at least a first group of Parlay Option 265) in 430. (In certain embodiments, method 400 can transmit or otherwise return information that is sufficient to identify or reconstruct the available Parlay Option(s) 265.)

As the reader will appreciate, a user is unlikely to be willing to wait a long time to receive his or her available Parlay Option(s) 265 from the Gaming Server 140 (or to have those Parlay Option(s) 265 otherwise determined, such as by a Gaming Terminal configured to internally perform one or more steps of methods 400 or 500) following the user's submission of his or her parlay parameters, such as in 325. As such, the time between (or the total time to complete) steps 410 (when method 400 receives the parlay parameters), 415 (when method 400 uses those parlay parameters to determine the available component wagers (and related information) that satisfy the user's parlay parameters), 420 (when method 400 groups the available component wagers and/or event outcomes by event), 425 (when method 400 determines the available Parlay Option(s) 265), and 430 (when method 400 ultimately returns/transmits the available Parlay Option(s) 265 to the Gaming Terminal 110 or other device or module from which the parlay parameters came) must be much faster than any person (or group of people) could possibly determine the available Parlay Option(s) 265 that satisfy the user's parlay parameters if such determination were to be performed by "pen and paper," so to speak. Indeed, in certain embodiments, the time that elapses between (or the total time to complete) steps 410, 415, 420, 425, and 430 is less than one second. In other embodiments, the time that elapses between (or the total time to complete) steps 410, 415, 420, 425, and 430 can be slightly longer, but still very short (and within the bounds of a modern user's attention span), and, in various embodiments, can be less than one minute, less than 30 seconds, less than 20 seconds, less than 10 seconds, less than 5 seconds, less than 4 seconds, less than 3 seconds, or less than 2 seconds.

As was discussed in more detail above, when the available Parlay Option(s) 265 (or the first group of available Parlay Option(s) 265, or information sufficient to identify or reconstruct some or all of the available Parlay Option(s) 265) is transmitted in 430 (such as, e.g., to the Gaming Terminal 110 that submitted the parlay parameters to the Gaming Server 140) or otherwise returned to method 300, method 300 (e.g., the Gaming Terminal 110 that submitted the parlay parameters to the Gaming Server 140) will receive those available Parlay Option(s) 265 (or the first group thereof) in 330, display those available Parlay Option(s) 265 (or the first group thereof) in 335, receive the user's parlay selection(s) in 340, and, at least in certain embodiments, transmit the user's parlay selection(s) (such as, e.g., to Gaming Server 140) in 345. (As the reader will appreciate, and as discussed elsewhere herein, in some embodiments, a Gaming Terminal 110 can be configured to perform one or more steps of methods 400 and/or 500. In such a situation, step 345 can be satisfied by the Gaming Terminal 110 "submitting" the user's parlay selections to itself for internal processing, rather than "transmitting" the user's parlay selections per se.)

Method 400 then receives the user's parlay selection(s) in 435, and in certain embodiments, proceeds to validate and/or confirm those parlay selection(s) in 440. This validation and/or confirmation step can include functionality such as determining that the odds provided for each event outcome are still valid, and/or determining that aggregate risk parameters associated with any selected Parlay Option 265 (and/or the event outcomes included therein) have not been exceeded (and would not be exceeded as a result of Parlay Option 265) across the entire system, such as, e.g., integrated gaming system 100.

With respect to determining that the wagering information provided for each event outcome is still valid, the system may be designed to ensure that the moneyline (or the point spread or other information that can be converted to a moneyline) that was offered with respect to any given event outcome has not changed (at least not beyond a tolerable amount, which can be configured by an administrator of the integrated gaming system) since the available Parlay Option(s) 265 were determined and displayed to the user. This is important to consider because, even though the integrated gaming system 100 (and the subcomponents thereof) is designed to perform the respective actions required of the integrated gaming system in a very timely manner, similar constraints are not necessarily placed on the user in making his or her selections (although such time constraints may be placed on a user, such as, e.g., by only allowing a user a set amount of time to make his or her parlay selections before the Parlay Option(s) 265 that were presented to the user "time out" and/or are otherwise invalidated). For instance, and particularly in the absence of such time constraints being imposed by the integrated gaming system and/or a component thereof, a user can potentially take a few minutes (or longer, and perhaps much longer) to make and submit his or her parlay selections after the available Parlay Option(s) 265 are displayed in 335. Regardless of the exact amount of time that elapses during that period (i.e., even if only a few seconds elapse during this period), something (e.g., an injury, suspension, or breaking weather report, among many other possibilities) may happen that causes the odds associated with any given event outcome(s) included in a given Parlay Option 265 to shift (beyond a tolerable amount) prior to the user submitting his or her parlay selections. As such, method 400 can determine in 440 whether any such movement on the moneyline (or the point spread or other information that can be converted to a moneyline) of one or more event outcomes included in a Parlay Option 265 selected by the user caused the odds associated with that Parlay Option 265 to change (beyond a tolerable amount), in which case the selected Parlay Option should be invalidated (and/or not confirmed) in 440. Likewise, method 400 can determine in 440 whether anything happened that caused one or more event outcomes included in the Parlay Option 265 to somehow invalidate the Parlay Option 265 entirely, particularly in extreme circumstances (e.g., where something so drastic occurs that the odds makers pull the game entirely; or perhaps where an event that was included in the Parlay Option has already begun), in which case the selected Parlay Option should also be invalidated (and/or not confirmed) in 440.

With respect to the desire to determine that certain aggregate risk parameters have not been exceeded, integrated gaming system 100 (and/or one or more components thereof) may be configured to ensure that the aggregate risk parameters associated with any selected Parlay Option 265 have not been exceeded across the entire system (such as, e.g., between the time when the Parlay Option(s) 265 were determined in 425, and the moment when the user's parlay selections were received in 435), and likewise to confirm that acceptance of the specific Parlay Option(s) 265 being analyzed would not cause those risk parameters to be exceeded. A reason for performing analysis of this sort is to minimize the risk of any single event outcome (or combination of event outcomes) creating a financial hardship (or worse) for the entity that is operating an integrated gaming system, such as, e.g., integrated gaming system 100. For instance, consider a scenario where the New England Patriots are playing the Miami Dolphins in the last week of the NFL's regular season, and where the Patriots can secure a first-round bye for the playoffs with a win against the hapless Dolphins, and as such, the Dolphins are significant underdogs to the heavy favorite Patriots. However, this scenario also means that the Dolphins offer attractive odds, perhaps in the neighborhood of a +660 moneyline. This means that a $100 wager on the Dolphins would require a $660 payout if the Dolphins win the game, which some bettors might find attractive. As such, a disproportionately large amount of money could be wagered on parlays (including, at least potentially, single-team parlays) that include the Dolphins winning the game outright (as actually happened in the last week of the 2019 NFL regular season). If a scenario occurred where too much money was wagered on this outcome, the entity operating the integrated betting system could suffer severe financial losses, potentially even including being forced into bankruptcy. Other similar problems could occur if too much money was wagered on a single Parlay Option 265, and that Parlay Option 265 "hit" (e.g., all of the event outcomes included in that Parlay Option 265 came to pass, such that a payout was required to any user who had wagered on that Parlay Option 265). The exact logic and parameters of such a risk analysis are beyond the scope of this disclosure, but the general ability to perform such a risk analysis should be mentioned, and can be performed at step 440 of method 400. And of course, should the risk analysis determine that one or more risk parameters have been exceeded or would be exceeded if a given Parlay Option 265 is accepted, the selected Parlay Option should also be invalidated (and/or not confirmed) in 440.

Conversely to the above, if the none of the offered moneylines (or the point spread or other information that can be converted to a moneyline) associated with an event outcome included in a given Parlay Option 265 have changed (beyond a tolerable amount), no risk parameters have been or would be exceeded by allowing the user to wager on this Parlay Option 265, and the Parlay Option 265 has not otherwise been invalidated for any other reason, method 400 should confirm the selected Parlay Option at 440.

In light of the results of 440, method 400 can then determine in 445 whether the user's selected Parlay Option(s) 265 are still valid. If method 400 determines that the user's selected Parlay Option(s) 265 are not still valid and/or were not confirmed, method 400 proceeds to 450 and returns an error message (or other message, indication, etc.) to the Gaming Terminal 110 that provided the parlay selection(s) at issue. (In such a situation, and although not expressly shown in FIG. 3, Gaming Terminal 110 can display an appropriate error message to the user, or take other corrective action, including giving the user the option to return to step 335 of method 300 and proceed from there in order to select new Parlay Option(s) 265.) If method 400 determines that the user's selected Parlay Option(s) 265 are still valid and/or were confirmed, method 400 proceeds to 455 and returns a confirmation message (or other indication) to the Gaming Terminal 110 indicating that submitted the parlay
selection(s) that are still valid and/or have been confirmed.

As the reader will appreciate, a user is unlikely to be willing to wait a long time for his or her parlay selection(s) to be validated and/or confirmed (or for his or her parlay selection(s) to be invalidated, and appropriate corrective measures taken). As such, the time between (or the total time to complete) steps 435 (when method 400 receives the user's parlay selections), 440 (when method 400 validates and/or confirms the user's selected Parlay Option(s)), 445 (where method 400 determines whether the user's parlay selection(s) is/are still valid) and either 450 (where method 400 returns an error message) or 455 (where method 400 returns a confirmation message) must be much faster than any person (or group of people) could possibly validate the parlay option(s) that the user selected, if such determination were to be performed by "pen and paper," so to speak. Indeed, in certain embodiments, the time that elapses between (or the total time to complete) steps 435, 440, 445, and either 450 or 455, is less than one second. In other embodiments, the time that elapses between (or the total time to complete) steps 435, 440, 445, and either 450 or 455 can be slightly longer, but still very short (and within the bounds of a modern user's attention span), and, in various embodiments, can be less than one minute, less than 30 seconds, less than 20 seconds, less than 10 seconds, less than 5 seconds, less than 4 seconds, less than 3 seconds, or less than 2 seconds.

Method 400 also updates risk information 460 and updates parlay wager information in 465, both of which can be stored in a storage such as, e.g., Parlay Information Storage 149. FIG. 4 depicts these steps as occurring after step 450, which will achieve the fastest result from the user's point of view (since the confirmation is sent before the tables are updated). In practice, however, steps 455, 460, and 465 can be performed in any order, and one or more of these steps can be performed in parallel to one or more of the other steps. Regardless of the order in which these steps are performed, the purpose of these steps is to accurately track the parlay wagers that are being placed, and the individual event outcomes that are included in those parlay wagers.

For instance, with respect to 460, risk information should be kept and updated to allow the integrated gaming system to track the aggregate risk (e.g., outstanding wagers) related to any one event (e.g., the Texas vs. Oklahoma college football game in 2019), event outcome (e.g., Texas beating Oklahoma in their 2019 college football game, or the total points scored in that game (i.e., the "total") going "over" a certain number), or Group (e.g., whatever Group ID is assigned to the Texas vs. Oklahoma college football game in 2019, which would include all of the event outcomes related to that event for which wagering information is available). Likewise, risk information should be tracked with respect to each Parlay Option 265 upon which one or more wagers have been placed to ensure that the aggregate risk (e.g., the amount that the entity operating the integrated gaming system would have to payout if that Parlay Option "hits") does not exceed any system wide risk parameters. For instance, in a given weekend, the following four-team parlay may be extremely popular in a state such as Texas: (1) the Texas Longhorns to beat the Oklahoma Sooners in college football, (2) the Houston Cougars to beat the Cincinnati Bearcats in college football, (3) the Houston Texans to beat the Kansas City Chiefs in NFL football, and (4) the Dallas Cowboys to beat the New York Jets in NFL football. As such, if a disproportionate amount of money was bet on this parlay (as viewed in the aggregate across the integrated gaming system), if this parlay were to "hit" (e.g., the Texas Longhorns, Houston Cougars, Houston Texans, and Dallas Cowboys all win), the entity operating the integrated gaming system could be required to payout a disproportionately large amount to the users who held this winning ticket. As such, the system should preferably track the aggregate amount that has been bet (across the integrated gaming system) on each individual Parlay Option 265, which can be done in 460.

With respect to 465, the system also must track the specific Parlay Option(s) 265 that were wagered upon, and the amounts of each of those individual wagers, as well as any other information associated with each individual wager. For instance, and as examples but not requirements, an integrated gaming system may wish to desire a user's (real) name, a username, or other information identifying the user who placed a given wager; a QR code or other unique identifier associated with that wager; information identifying a store at which the wager was placed, as retailers often receive a portion of winning lottery tickets; the date on which the wager was placed, and so forth, among many other such potential options. In short, the purpose of tracking this information is to have the ability to confirm that any "winning tickets" that a user attempts to cash in are, in fact, valid winning tickets that were sold through the integrated gaming system, and that the other information associated with any such tickets is valid and correct, in addition to other potential purposes for tracking such information. As such, the system should preferably track the each individual wager that has been placed (across the integrated gaming system), which can be done in 465.

Turning next to FIG. 5, FIG. 5 is a flowchart of a method 500 illustrating various actions performed in connection with certain embodiments of the systems and techniques disclosed herein. To provide more detail, FIG. 5 is a flowchart of a process 500 that may be performed by a computing device (such as, e.g., Gaming Server 140) and/or a module or process (such as, e.g., one or more instances of Parlay Selection Module 143) operating in the "cloud" (such as, e.g., Cloud 170), as described herein. In other embodiments, one or more steps of method 500 may be performing by a Gaming Terminal 110, or any other such device that is configured to perform one or more steps of method 500. FIG. 5 provides enhanced details of step 425 of method 400, and as such discloses functionality related to determining the Parlay Option(s) 265 that are available in light of the user's parlay parameters and other inputs provided to method 500. In other embodiments, process 500 may also be performed in conjunction with one or more steps of one or more other processes described herein, such as method 300 and portions of method 400 other than (or in addition to) 425.

In certain embodiments, method 500 begins at 510, where the method launches (or otherwise deploys, instantiates, invokes, and so forth, which terms will collectively be referred to herein by the word "launches" and grammatical variants thereof) a new computer process (or session, or thread, or the like, which terms will collectively be referred to herein by the word "process" and grammatical variants thereof) for each collection of parlay parameters that is received (such as, e.g., from a Gaming Terminal 110) in 410. In certain embodiments, Node.js can be used to launch this new process. In other embodiments, other functionality can be used to launch this new process. In certain embodiments, the new process can be launched within the server (or other computing device) that is performing method 400 (with respect to the current set of parlay parameters that had been received in 410 and which are now being operated upon). In such embodiments, the new process can be launched, e.g., within Gaming Server 140 or the Gaming Terminal 110 being used by the user to submit his or her parlay parameters, and so forth, with the former option being shown in FIG. 1A. In certain embodiments, the new process can be launched in a cloud computing environment, such as, e.g., Cloud 170, as shown in FIG. 1B. In certain embodiments, a new process is not necessarily launched for every collection of new parlay parameters that is received in 410.

At 515, the method receives one or more inputs that are relevant to the performance of method 500. For instance, in certain embodiments, method 500 receives some or all of the user's parlay parameters (such as, e.g., the parlay parameters that were received in step 410 of method 400), information pertaining to the available wagers (such as, e.g., the available events, outcomes of those events (i.e., event outcomes), moneylines or a point spread or other information that can be converted to a moneyline, and related information that was determined in step 415 of method 400), and/or group information pertaining to the available wagers (such as, e.g., the group information that was determined in step 420 of method 400). (As was discussed above in conjunction with 415, in certain embodiments the moneylines received at 515 can be "zero juice moneylines" that the method can convert to the moneyline that will ultimately be offered to the user, such as, e.g., as part of a Parlay Option 265, which can be done by factoring in the integrated gaming system operator's edge and which can be referred to as an "offered moneyline." In other embodiments, the integrated gaming system operator's edge may have already been factored into the moneylines that were retrieved at this point, in which case the integrated gaming system operator's edge would not have to be factored in a second time, and the retrieved moneyline can be used as is.) In certain embodiments, these inputs can be received by the process that was launched in 510. In other embodiments, these inputs can be received by a different component of an integrated gaming system, such as, e.g., integrated gaming system 100. In still other embodiments, one or more of these inputs can be calculated by method 500 itself, or by the module or component of integrated gaming system 100 that is performing the current instance of method 500. In certain embodiments, these inputs can be received in the form of one or more predefined data structures, such as, e.g., a string in JSON or XML format. In other embodiments, these inputs can be received (or otherwise passed or accessed) in the form of a query string, one or more cookies, or one or more session variables (or parameters), as well as other means suitable for passing information of this kind.

In addition to the inputs received in 410, the inputs that are received in 515 can include information that defines a parlay size (i.e., a "cardinality"); a "space" variable; the natural logarithm of the user's target probability, which is the probability associated with the ratio between the user's desired wager and payout, and which can be thought of as the risk-to-reward ratio reflected by the user's parlay parameters; and a collection (e.g., array, list, dictionary, tuple, and so forth) of available component wagers, where each component of the collection of available component wagers includes a Group ID (such as was determined and/or assigned in 420) and the zero juice moneyline and/or offered moneyline (or a point spread or other information that can be converted to a moneyline) of the associated event outcome. In certain embodiments, the inputs received in 515 can include the user's target probability without requiring that target probability to be expressed as a natural logarithm. Each of these items will be discussed in more detail in the following paragraphs.

As used herein, the term "cardinality" is used to indicate the desired number of individual wagers (e.g., event outcomes, and each event outcome's associated moneyline or a point spread or other information that can be converted to a moneyline) within a single Parlay Option 265. As such, the cardinality of a desired Parlay Option 265 reflects the desired parlay size (e.g., the desired number of event outcomes to be included in the available Parlay Option(s) 265) that the user specified in his or her parlay parameters, and as such, the cardinality of a desired Parlay Option 265 will therefore generally be referred to herein as the "size" of a Parlay Option 265.

The "space" variable is used to control the size of the data structures (e.g., tables, multi-dimensional arrays, and so forth) that will be constructed when calculating the available Parlay Option(s) 265 in step 525. In one embodiment, the total space and time of the computation performed in 525 is linearly proportional to the value of this "space" variable. As such, setting this "space" variable to a higher value tends to produce greater accuracy of the calculated results, but does so at the expense of increasing the space and time complexity of the computation performed in 525. Conversely, setting this "space" variable to a lower value tends to reduce the accuracy of the calculated results, but also reduces the space and time complexity of the computation performed in 525. As will be discussed further below, the accuracy of the results can be measured in terms of how close the offered probability of each calculated (available) Parlay Option 265 comes to the user's target probability as expressed in his or her input parameters. Accuracy of the results can also be understood in terms of how many available Parlay Options 265 are identified by method 500, in comparison to the entire universe of all such Parlay Options 265 that might have been available if maximum precision had been achieved (albeit at the expense of a potentially dramatic increase in the time needed to compute the results). In one embodiment, this "space" variable is set to 250 by default. In other embodiments, other values are possible as well.

As noted above, the user's target probability (or, the natural logarithm value of the user's target probability) reflects the target probability associated with the user's desired wager and payout, where the target probability can be thought of as the risk-to-reward ratio reflected by the user's parlay parameters. The target probability can be calculated by dividing the user's desired wager, by the sum of the user's desired wager plus the user's desired payout, which can be represented as: target_probability=desired_wager/(desired_wager+desired_ payout). For example, if the user wants to risk (wager) $100 to make $900 (the payout), then the target probability can be calculated as: target_probability=100/(100+900)= 100/1000=1/10. In certain embodiments, the natural logarithm value can then be calculated by taking the natural logarithm of the user's target probability (1/10). As such, in this example, the natural logarithm value associated with the user's target probability would be ln(1/10), which equals −2.303 (when rounded to three decimal places). In other embodiments, many other values for the natural logarithm of the user's target probability are possible, with each such value being calculated in the same general manner described in this paragraph.

The collection of available wagers (e.g., event outcomes, and each event outcome's associated offered moneyline (or the point spread or other information that can be converted to a moneyline)) can be stored in any of various data structures designed to hold such collections of information, such as, e.g., a multi-dimensional array, a list, a dictionary, a tuple, and so forth, with the term "collection" being used herein to generically reference any data structure that is appropriate for holding such information. The collection of available wagers can include information describing, or otherwise identifying or related to, the wagers that are eligible to (at least potentially) be included in one or more of the Parlay Options 265 that will be computed in 525. For example, suppose a user indicates in his or her parlay parameters that s/he only wants to consider wagers related to the NFL and NCAA football. In that case, the collection of available wagers will only include entries for wagers related to the NFL and NCAA football, but would not any entries related to, e.g., MLB, NASCAR, or soccer. Similarly, if a user indicates that s/he wants to "exclude" a certain bet type (e.g., bets on the over/under (total points scored)), then the collection of available wagers should exclude such bet types from the collection of available wagers. (The reader will appreciate that in certain embodiments, any bet types that are not specifically excluded, will be included by default.) So for instance, if the user specified that s/he wanted to consider wagers related to the NFL and NCAA football games, in the date range of Dec. 14-16, 2019, and to exclude "prop" bets, the collection of the available wagers may include Army and Navy (separately) as the potential winners of the Army vs. Navy game (which was the only NCAA college football game played that weekend, at least in the Bowl Championship Subdivision of the NCAA); the "over" and the "under" of the Army vs. Navy game; every NFL team other than the New York Jets and Baltimore Ravens, who played on Thursday, Dec. 12, 2019, which was outside the date range specified in this example; the other 30 NFL teams all had a game within that date range, as the potential winners of each of the various NFL games within the user's chosen date range, and the "over" and the "under" of each NFL game being played in that date range.

In certain embodiments, each individual available wager included in this collection of available wagers can be represented by an array of length two (2) where the first component of the array is an integer specifying the "group" to which the available wager (such as was determined, e.g., in 420) belongs, and the second component is the offered moneyline (or a point spread or other information that can be converted to a moneyline) of the associated event outcome. Turning first to the concept of grouping, and as noted above, method 400 (in 420) "groups" all of the event outcomes for a single game, and assigns each such group a unique Group ID. So for example, with respect to the LSU vs. Oklahoma College Football Playoff game in the 2019-20 season, the potential event outcomes would have included LSU winning, Oklahoma winning, LSU QB Joe Burrow throwing more than 3.5 touchdown passes, LSU QB Joe Burrow throwing less than 3.5 touchdown passes, the total score going "over" 73.5, and the total score being "under" 73.5, among other such options. Since each of the event outcomes mentioned in the previous sentence are related to the same game, all of these event outcomes would be assigned the same Group ID. Method 500 then uses this group information to ensure that no more than one event outcome per group (game, match, other event type, and so forth) is included in any given Parlay Option 265. For instance, this functionality ensures that no Parlay Option includes any events that are positively correlated (e.g., Joe Burrow throwing more than 3.5 touchdown passes, and the total score going "over" 73.5) to each other, which could cause the actual odds of the parlay hitting to differ from the calculated odds of the parlay hitting. This functionality also ensures that no Parlay Option includes any events that are negatively correlated (e.g., LSU winning, and Oklahoma winning the same game, as one example; or Burrow throwing more than 3.5 touchdown passes, but the total score being "under" 73.5) to each other, which could unfairly hurt the user (as it would be unlikely, e.g., that Burrow would throw at least four touchdown passes in a game that was lower scoring than expected) or even make it outright impossible for the user to win his or her parlay (as it would be impossible, e.g., for both LSU and Oklahoma to win the same game when they are playing each other).

Turning next to the moneyline offered in association with each event outcome, this information can generally be determined in 415, and will generally take the form of either a positive integer (e.g., +900) or a negative integer (e.g., −110). When the offered moneyline is positive (e.g., +900), the integer represents the amount of money that a bettor would win for every $100 bet on that event outcome (assuming we are dealing with U.S. Dollars; the same general logic applies to other currencies, as well). For instance, an offered moneyline of +900 represents a scenario where a user would win $900 for every $100 wagered, or some other multiple of that ratio, such as, e.g., winning $90 for every $10 wagered. When the offered moneyline is negative (e.g., −110), the integer represents the amount of money that a bettor is required to risk (or wager) in order to win $100. For instance, an offered moneyline of −110 indicates that a user would have to wager $110 to win $100, or some other multiple of that ratio, such as, e.g., wagering $11 to win $10. In other embodiments, such as where only a point spread (or other information that can be converted to a moneyline) might be available, the integrated gaming system can use historical data or other information to convert the point spread (or other information) to an (approximate) moneyline that is to be offered. In still other situations, where two related bets are considered equally likely (such as, e.g., the total score of a game going "over" a certain number (or "total"), as one potential event outcome; and the total score of that same game finishing "under" the same total, as a second potential event outcome), the system may assign each option a default moneyline value (such as, e.g., −110), which, at least in certain embodiments, can also be used as the offered moneyline.

At 520, method 500 performs preliminary processing to convert the offered moneylines to natural logarithm values, as natural logarithm values are easier and faster to process throughout the rest of the method. As such, this preliminary processing significantly increases efficiency and reduces the time needed to perform the rest of method 500, portions of which could otherwise be extremely time intensive. Accordingly, this conversion step addresses and solves a major problem that would otherwise be present in attempting to perform a computation such as this, which, of course, is a critical component of the integrated gaming system described herein, and the efficiency, usability, and desirability thereof, all of which help drive the marketability of such an integrated gaming system, as well as the revenue generated thereby.

Step 520 first converts the offered moneyline associated with each event outcome to a probability to be offered (i.e., an "offered probability") associated with that event outcome occurring, and then computes the natural logarithm of that probability. Once the offered moneyline for each available event outcome is ascertained or otherwise determined, the offered probability of each event outcome actually occurring is determined by taking the moneyline for each available event outcome and converting that offered moneyline to an offered probability, which is done as follows: For each available event outcome associated with a negative offered moneyline (e.g., −110), the offered probability associated with that event outcome occurring is the absolute value of the offered moneyline (e.g., 110, which is the absolute value of −110), divided by the sum of 100 and the absolute value of the offered moneyline (e.g., 210, which is the sum of 100 and 110, the latter of which is the absolute value of −110). So for such a wager, the offered probability would be calculated as (110/(100+110))=110/210=11/21. For each available event outcome associated with a positive offered moneyline (e.g., +900, or simply, 900), the offered probability associated with that event outcome occurring is 100 divided by the sum of 100 and the offered moneyline (e.g., 1000, which is the sum of 100 and the offered moneyline of 900). So for such a wager, the offered probability would be calculated as (100/(100+900))=100/1000=1/10.

After the offered moneyline for each available event outcome is converted to an offered probability, such as, e.g., in the manner described above, method 500 calculates the natural logarithm of that offered probability. So for instance, the natural logarithm of the offered probability associated with a wager having an offered moneyline of −110 is calculated as ln(11/21), which equals −0.647 (when rounded to three decimal places). Similarly, the natural logarithm of the offered probability associated with a wager having an offered moneyline of +900 is calculated as ln(1/10), which equals −2.303 (when rounded to three decimal places). Method 500 can then discretize each of these natural logarithm values over an appropriate interval. For instance, by converting the offered probabilities to natural logarithm values, the method can now compute sums instead of products, which provides a substantial time savings when spread across many calculations. Moreover, the sums that have to be computed here all lie between the number zero and twice the natural logarithm of the user's target probability, the latter of which is a negative number. Thus, in one embodiment, the method can discretize these natural logarithm values by using 32-bit unsigned values, and mapping zero (in the range of natural logarithm values mentioned above) to 0 (in range of 32-bit unsigned values) and mapping twice the natural logarithm of the user's target probability to the max unsigned 32-bit value (e.g., $2^{32}-1$), and using linear interpolation (and rounding to 32-bit precision) to map all of the intervening natural logarithm values to 32-bit unsigned values.

As a result of the foregoing, each available event outcome can be represented as a {GroupID, value} pair, which can be stored in an array, dictionary, list, or other appropriate data structure, where the "value" in each pair is the discretized value associated with that event outcome, as discussed above. Method 500 can then produce a collection of such {GroupID, value} pairs corresponding to the collection of available wagers that was determined, e.g., in 415. That collection of {GroupID, value} pairs can be stored in any suitable data structure, such as a multi-dimensional array (e.g., an array of arrays), a dictionary, list, or other such data structure, including but not limited to the examples of such data structures provided herein. In certain embodiments, the integrated gaming system can also store this information in a temporary memory, or in a storage such as, e.g., Parlay Information Storage 149 or Odds and Wagering Information Storage 153. In other embodiments, this information can be stored in a different manner or location.

At 525, and at least in part by using the inputs received at 515 and the results of 520, method 500 determines an available Parlay Option 265 that satisfies the user's desired parlay parameters. At 530, method 500 determines if an acceptable Parlay Option 265 was identified in the most recent iteration of 525. If not, method 500 proceeds to 550, which will be discussed in more detail below. If so, then method 500 proceeds to 535, where method 500 calculates the offered probability (and/or the natural logarithm of the offered probability) associated with the Parlay Option 265 that was identified in 525. At 540, method 500 calculates the "error" (or the difference) between the offered probability (and/or the natural logarithm of the offered probability) associated with the Parlay Option 265 that was identified in 525, and the user's target probability (and/or the natural logarithm of the user's target probability). At 545, method 500 determines if any other Parlay Option(s) should be identified. If so, method 500 returns to 525. If not, method 500 proceeds to 550, which will be discussed in more detail below. Although steps 515, 520, 525, 530, 535, 540, and 545 are shown as discrete steps in FIG. 5, and discussed as discrete steps herein, the reader will appreciate that in practice, certain portions of any of these steps can be performed as part of another one or more of these steps without negatively affecting the overall functionality of the disclosure provided herein. Moreover, although these steps are shown and discussed as occurring in a certain order herein, which is done primarily for ease of discussion, in practice one or more of these steps can be performed in a different order than what is shown in FIG. 5 and discussed herein. Similarly, one or more of these steps can be performed simultaneously (or substantially simultaneously) and/or in parallel (or substantially in parallel) with one or more of the other steps 515, 520, 525, 530, 535, 540, and 545. Nevertheless, primarily for ease of discussion, the current discussion will continue to treat 515, 520, 525, 530, 535, 540, and 545 as discrete and separate steps, at least for purposes of the discussion herein.

Turning first to 525, by the time this step is performed, method 500 will generally be aware of the inputs that were received in 515 and the values that were calculated in 520. As such, 525 will generally be aware of at least a collection of {GroupID, value} pairs; the user's desired parlay size, which will be referred to by the variable k herein; and two other nonnegative integers, namely, a target sum and the "space" value referenced above, which can be used to regulate the amount of memory space and time used to perform certain calculations discussed herein. Step 525 uses this information (in addition to other logic and functionality described herein, as well as other potential information) to identify a subset S of the collection of {GroupID, value} pairs such that no two {GroupID, value} pairs in subset S share the same group ID, and the sum of the values of the {GroupID, value} pairs in subset S is as close to the target sum (e.g., the natural logarithm of the user's target probability) as possible.

To achieve these desired ends, in certain embodiments method 500 converts the set of {GroupID, value} pairs into a collection of "Options" objects (or other suitable data structures). Each Options object contains a number of "Option" objects. In certain embodiments, the method creates one Options object for each distinct GroupID in the collection of {GroupID, value} pairs; and, for any given GroupID, the associated Options object contains one Option object for each distinct valued paired with that GroupID. For instance, assume that a college football game between LSU and Clemson is assigned "101" as the GroupID. Also assume that LSU is −220 to win, Clemson is +180 to win, the total is 69.5 (with an offered moneyline of −110 on each of the "over" and the "under" bets against that total), and a prop bet on the results of the opening coin flip is "heads" at −110 and "tails" also at −110. Keeping in mind that the "value" in these pairs is the natural logarithm of the offered probability associated with the offered moneyline, the {GroupID, value} pairs for this game could be represented as follows: {101, −0.375} (which corresponds to a −220 offered moneyline), {101, −1.030} (which corresponds to a +180 offered moneyline), {101, −0.647} (which corresponds to a −110 offered moneyline), {101, −0.647}, {101, −0.647}, and {101, −0.647}. (As the reader will appreciate, the "over," "under," "heads," and "tails" bets for this game all have an offered moneyline of −110, which results in four of the {GroupID, value} pairs being identical in the list provided above.) As such, one "Options" object would be created for the GroupID of 101, and that Options object would contain one Option object for each distinct value that is paired with that Group ID. As a result, the Options object (for the GroupID of 101) would only contain three Option objects, as follows: {−0.375, −1.030, −0.647}. This occurs (even though the list above covers six bets for this game) because four of the {GroupID, value} pairs in the list provided above are identical (i.e., the have the same GroupID and the same value). As such, one Options object would have been created here for the GroupID of 101, and that Options object would include three Option objects having the values of {−0.375, −1.030, −0.647}. Other such collections of Options objects that include Option objects could be created for other events, such that a collection of such Options objects would ultimately exist. (Of course, if the user's parlay parameters are such that only one event is available that satisfies his or her chosen leagues and the relevant date or date range, then the collection of Options objects may ultimately only include a single Options object.) In certain embodiments, the method can be further optimized by removing groups of offered probabilities that have the same value, and replacing that entire group with a single placeholder group to represent the value of that offered probability, which reduces the time needed to perform the necessary functionality as discussed herein. Then, if a Parlay Option containing that value is selected, the method can then choose one of the event outcomes associated with any offered probability in the group of offered probabilities that was removed and replaced with the placeholder group.

Once the collection of Options objects are created, the method can partition the collection of Options objects into two sets of approximately equal size, which will be referred to herein for purposes of discussion as a "first subset" and a "second subset." Partitioning the Options objects into subsets has the advantage of reducing the time and space complexity of the computations that occur in the following steps, which creates a significant time savings and memory space when computing the available Parlay Options. Accordingly, this step also addresses and solves a major problem that would otherwise be present in attempting to perform a computation such as this, which, of course, is a critical component of the integrated gaming system described herein, and the efficiency, usability, and desirability thereof. Although only two subsets will be used for purposes of the discussion herein, in other embodiments a different number of subsets can be created as well. For instance, if the user's parlay parameters cover a very large number of possible event outcomes, it may be desirable to pick a random subset of those outcomes to work with, and then partition that subset into two further subsets, such as described above. Alternatively, it may be desirable to create more than two subsets here, in order to further mitigate the time required for the subsequent computations. Conversely, if there are a relatively low number of Options objects that satisfy the user's parlay parameters and the other aforementioned inputs, then it may be desirable to only have a single "subset" (i.e., the original collection of Options objects), in order to maximize the possibility of at least one available Parlay Option being found that satisfies the user's parlay parameters.

Regarding the partitioning itself, in certain embodiments this partitioning can occur by placing the first Options object (of the collection) into the first subset, placing the second Options object (of the collection) into the second subset, placing the third Options object (of the collection) into the first subset, and so on, such that the $1^{st}$, $3^{rd}$, $5^{th}$, etc. Options objects are placed into one subset, and the $2^{nd}$, $4^{th}$, $6^{th}$, etc. Options objects are placed into the other subset. In other embodiments, a random partitioning strategy can be used. For instance, a random partitioning strategy may involve generating a pseudorandom bit (e.g., pseudorandomly choosing a 0 or 1) for each Options object, and then using that bit to determine whether to put that Options object in the first subset (e.g., if the pseudorandom bit is a 0) or in the second subset (e.g., if the pseudorandom bit is a 1). In other embodiments, the random partitioning strategy described above can be modified to proceed as described above until one subset is determined to be "full" (e.g., when the subset contains half of the Options objects, if there are an even number of Options objects; or as soon as one subset contains more than half of the Options objects, if there are an odd number of Options objects), and then place all of the remaining Options objects in the other subset in order to at least approximately (and perhaps exactly) even out the number of Options objects between the subsets. In other embodiments, this partitioning can occur in different manners (e.g., the first n number of Options objects are placed into one subset, the next n number of Options objects are placed into the other subset; or the first half of the Options objects are placed into one subset, and the remaining Options objects are placed into the other subset; among many other such possibilities). However, the method of partitioning described above typically has the advantage of increasing the likelihood that both subsets have a mixture of events from different leagues (e.g., NFL games, NCAA college football games, NBA games, etc.) and/or any other event categories that the user selected in his or her parlay parameters as compared to other methods. For instance, and as a contrary example, if the user selected NFL and NBA games as his or her chosen leagues, and the collection of Options objects was partitioned by putting the first half of the Options objects into one subset, and the remaining Options objects into the other subset, it is quite possible that one subset could include almost all NFL games and few if any NBA games, and the other subset could include the inverse of that arrangement. But by putting every other Options object in each subset (so the $1^{st}$, $3^{rd}$, 5th, etc., in one subset, and the $2^{nd}$, $4^{th}$, $6^{th}$, etc. in the other subset), it is more likely that each subset will include Options objects for roughly half of the events that are available for each league (or other event category) selected by the user.

Method 500 can then use dynamic programming to build a collection of tables (or other data structures) based on the Options objects in each subset. The number of such tables is essentially the product of k (the number of team's the user wants to have in each Parlay Option 265) and the number of Options objects in the given subset. Each table is allowed to grow as the computations proceed, but in certain embodiments, no table will be allowed to exceed a size that is twice the value of the "space" variable described above. The time required to construct the tables is roughly linear to the table size. As such, the time and space complexity of this table construction process dominates the overall running time of the algorithm, hence the need for the various time saving techniques described herein, which also addresses and solves a major problem that would otherwise be present in attempting to perform a computation such as this, which, of course, is a critical component of the integrated gaming system described herein, and the efficiency, usability, and desirability thereof.

Each table is built by looping through the Options objects in each subset. For each integer i between zero and the desired parlay size k, inclusive, the method computes the best Parlay Option 265 of size k that can be obtained by combining some parlay of size i (i.e., the current value of i in any given iteration through this loop) in the first subset with some size k−1 parlay in the second subset. As the method loops through this process, the method keeps track of the best parlay of size k that has been identified. In certain embodiments, the "best" parlay can be the parlay that has an actual probability that is closest to the user's target probability. In other embodiments, the "best" parlay can be determined in some other manner. In certain embodiments, only Parlay Options 265 that are within a certain degree of tolerance to the user's target probability will be considered. For instance, in certain embodiments, the method may only consider Parlay Options 265 having no more than a 5% error, or difference, between the actual probability of the Parlay Option 265 and the user's target probability as based on his or her parlay parameters. In other embodiments, other tolerance levels (e.g., other values of the aforementioned error, or difference) can be used.

The foregoing computation determines whether a combination of available wagers exists that satisfy the user's parlay parameters, but does not yet directly indicate what individual values (from the {GroupID, value} pairs in the collection of {GroupID, value} pairs) are associated with the computed parlay combination (assuming that such a parlay combination does exist). However, these individual values (from the {GroupID, value} pairs in the collection of {GroupID, value} pairs) can be determined by tracing back in the tables associated with the first subset and the second subset.

At this point, the method will be aware of what specific combination of moneylines the integrated gaming system should offer to the user as part of a Parlay Option 265 that satisfies the user's parlay parameters. For instance, the method may have determined that the system should offer the user a Parlay Option 265 with two −110 wagers, one+200 wager, and one+900 wager (for a 4-team parlay, for example). However, the system still must determine precisely which two −110 wagers, one+200 wager, and one+900 wager should be included in the Parlay Option. Because the system respects the group constraints (i.e., no single Parlay Option should include more than one wager from a single GroupID), the system cannot simply choose wagers at random that satisfy the combination of offered moneylines that have been determined up to this point. This problem is solved by assigning a random weight to each wager and then solving a max-weight max-cardinality matching (MWMCM) problem in a suitable bipartite graph. Using this approach, the method obtains a random combination of options that collectively satisfy the desired combination of offered moneylines and still respect the group constraints.

At 530, method 500 determines if a Parlay Option(s) 625 that satisfies the user's parlay parameters was identified in the most recent iteration of 525. If 530 determines that no Parlay Options were identified in the most recent iteration of 525, method 500 then proceeds to 550, which will be discussed in more detail below. If 530 determines that method 500 was able to identify a Parlay Option 625 that satisfies the user's parlay parameters in the most recent iteration of 525, method 500 then proceeds to 535.

At 535, method 500 calculates the odds that are to be offered in association with the Parlay Option 625 that was determined in 525 (i.e., the "offered odds"). This value is based on a probability of the Parlay Option 265 "hitting," e.g., the probability that each of the event outcomes included in the Parlay Option 265 will occur. In one embodiment, the probability that is to be offered (i.e., the "offered probability") in association with any given Parlay Option 265 "hitting" can generally be calculated as follows: For each event outcome associated with an offered moneyline that is negative (e.g., −110), the probability to be offered in association with that event outcome occurring is the absolute value of the offered moneyline (e.g., 110, which is the absolute value of −110), divided by the sum of (100 plus the absolute value of the offered moneyline) (e.g., 210, which is the sum of 100 plus 110, the latter of which is the absolute value of −110). So for such a wager, the offered probability would be calculated as (110/(100+110))=110/210=11/21. For each event outcome associated with an offered moneyline that is positive (e.g., +900, or simply, 900), the probability to be offered in association with that event outcome occurring is 100 divided by the sum of (100 plus the moneyline) (e.g., 1000, which is the sum of 100 plus the offered moneyline of 900). So for such a wager, the offered probability would be calculated as (100/(100+900))=100/1000=1/10. As such, for an example four-team Parlay Option that includes three event outcomes that each have a −110 offered moneyline and a fourth wager that has a +900 offered moneyline, the offered probability of that Parlay Option would be calculated as (11/21)×(11/21)×(11/21)×(1/10), which equals 1331/92610, or approximately 0.014372.

As the reader will appreciate, the offered probability of any given Parlay Option 265 hitting (or being a winner) will not necessarily be identical to the user's target probability, i.e., the probability related to the ratio between the user's specified ticket price (wager amount) and desired ticket win value (payout), although the offered probability should be fairly close to the target probability corresponding to the user's parlay parameters). As such, the offered probability for each available Parlay Option 265 should be determined and returned at this point, so that other components of the integrated gaming system have access to this information. In certain embodiments, the integrated gaming system can display the offered probability (or the offered odds corresponding to the offered probability) to the user, as part of (or in conjunction with) each Parlay Option 265 displayed in 335. (To calculate the odds associated with a probability, the system can divide the number one (1) by the offered probability calculated above to get the odds that should be offered in accordance with that Parlay Option. In the example provided in the previous paragraph, the odds would be equal to 1/0.014372, which equals approximately 69.6. Rounding this number up, the odds to be offered in association with this particular Parlay Option can be expressed to the user as being 70 to 1.

At 540, method 500 computes the "error" associated with the Parlay Option that was determined in 525. This error is simply the absolute value of the difference between (a) the probability associated with the user's desired or "target" wager and payout (as used herein, the "target probability"), and (b) the actual probability as calculated by method 500 for each corresponding event outcome include in each Parlay Option 265.

At 545, method 500 determines if another Parlay Option 265 should be identified at this time. In certain embodiments, this determination may be based on, e.g., determining whether the method has already computed the minimum number of Parlay Options 265 that the system is configured to display on the second screen of the user interface, such as can be seen, e.g., in FIG. 2B. In certain embodiments, this determination may be based on, e.g., determining whether the method has already computed a certain number of available Parlay Options 265 (such as, e.g., 10 or 20, among other such options), which number can be set to ensure that method 500 provides method 400 (and ultimately method 300) with a sufficient number of "extra" Parlay Options 265, in case the user wants to see more additional Parlay Options 265 after viewing the first set of Parlay Options 265 that are displayed to him or her, such as would be displayed, e.g., in FIG. 2B. In certain embodiments, this determination may be set to evaluate in the affirmative (or otherwise return to 525) by default, with the loop shown in FIG. 5 only breaking when 530 evaluates in the negative. If the determination of 545 evaluates in the affirmative (whether for one of the foregoing reasons, or otherwise), method 500 returns to 525 and attempts to compute another Parlay Option 265 that satisfies the user's parlay parameters, should one exist. However, on each iteration through 525 (other than the initial iteration of 525), the specific relevant information related to the Parlay Option 265 that was determined on the most recent pass through 525 is removed from future consideration. If the determination of 545 evaluates in the negative, method 500 proceeds to 550.

At 550, method 500 returns (or otherwise transmits) information describing any available Parlay Option(s) 265 (and/or the individual wagers included in those Parlay Option(s) 265) that were calculated by method 500, the probability (or odds) to be offered to the user in connection with each such Parlay Option 265, and the associated error that was calculated in 540. (In certain embodiments, method 500 is not necessarily required to return all of this information.) The information describing the available Parlay Option(s) 265 can include, e.g., information identifying each component wager of each Parlay Option 265 that was calculated by method 500, the offered probability associated with each such Parlay Option 265, and an "error" associated with each such Parlay Option 265. If method 500 was not able to identify any combination of wagers that would satisfy the user's parlay parameters, i.e., in the situation that 530 evaluated in the negative in the first pass through method 500, then method 500 can return an "empty" set or otherwise indicate that no Parlay Options are available to satisfy the user's parlay parameters.

In the situation that information is returned in 550, the information identifying each component wager of each Parlay Option 265, the probability (or odds) to be offered to the user in connection with each Parlay Option 265, the "error" associated with each Parlay Option 265, and other information to be returned can be stored in a string (such as, e.g., a JSON string) or other data structure (such as those listed above), such that each such string or other data structure includes each of these pieces of information for a single Parlay Option 265 that was calculated by method 500. Should method 500 determine that more than one available Parlay Option 265 exists, then in certain embodiments, a separate string or other data structure such as the one described above will be created for each of those available Parlay Options 265. These strings or other data structures can then be returned (or otherwise transmitted) to method 400 as a series of individual strings or other data structures, or they can be bundled (such as, e.g., into an array of strings or other data structures) and returned (or otherwise transmitted) to method 400 in that format, among other such possibilities for returning (or otherwise transmitting) this information to method 400 (or whatever other portion of the integrated gaming system needs such information).

At 555, the process that was launched in 510 should optionally be closed (or otherwise terminated), and any necessary garbage collection (or similar functionality) should optionally be performed at this time. Method 500 then ends.

Figure 6:
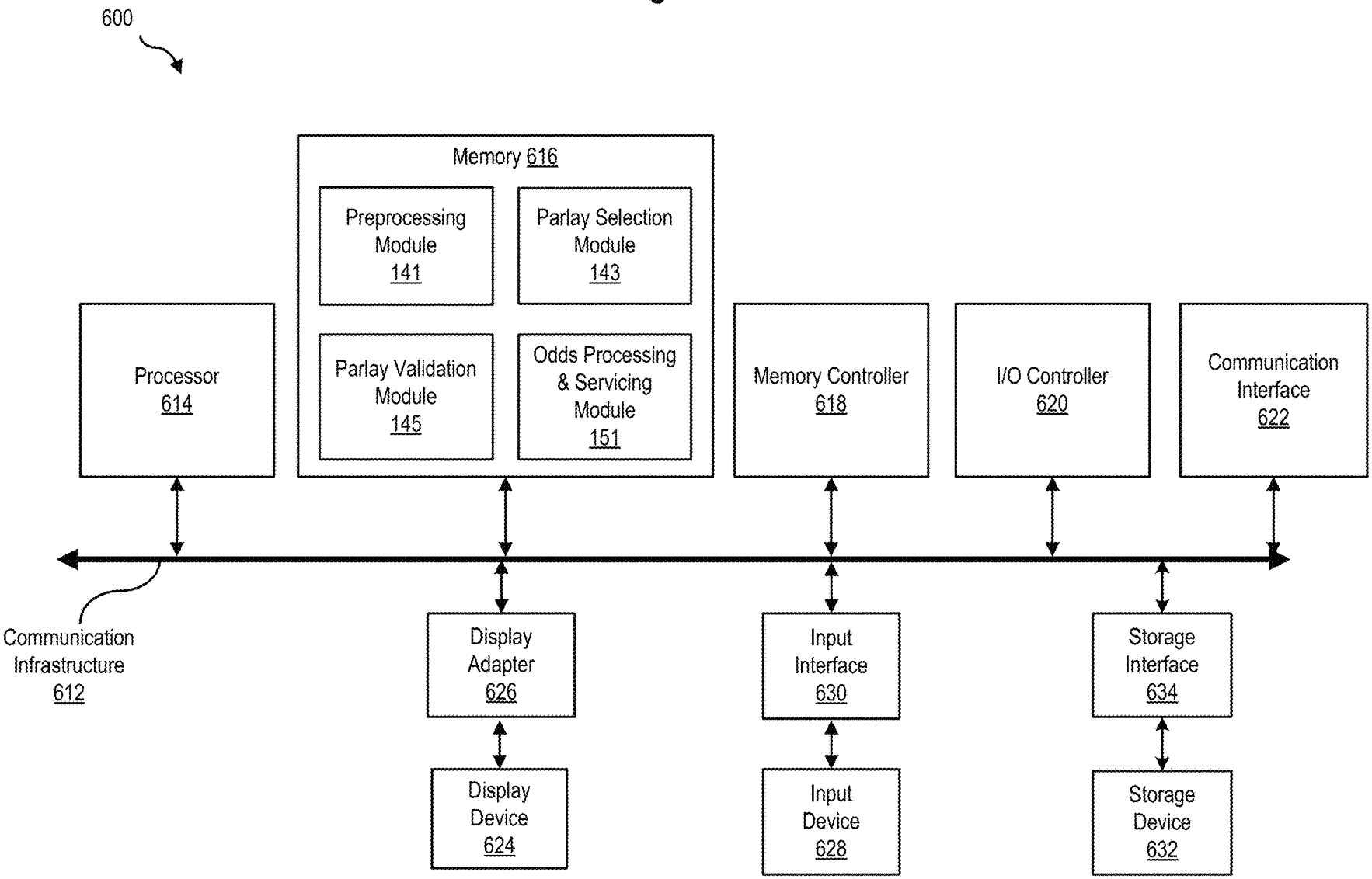
FIG. 6 is a block diagram of a computing device, illustrating how certain features of the instant disclosure can be implemented, according to one embodiment of the present disclosure.

FIG. 6 is a block diagram of a computing system 600 capable of performing one or more of the operations described above. Computing system 600 broadly represents any single or multi-processor computing device or system capable of executing computer-readable instructions. Examples of computing system 600 include, without limitation, any one or more of a variety of devices including workstations, personal computers, laptops, client-side terminals, servers, distributed computing systems, handheld devices (e.g., personal digital assistants and mobile phones), network appliances, storage controllers (e.g., array controllers, tape drive controller, or hard drive controller), and the like. In its most basic configuration, computing system 600 may include at least one processor 614 and a memory 616. By executing software that invokes, e.g., Preprocessing Module 141, Parlay Selection Module 143, Parlay Validation Module 145, and/or Odds Processing & Servicing Module 151, or any modifications thereof consistent with this disclosure, computing system 600 becomes a special purpose computing device that is configured to perform operations in the manner described above.

Processor 614 generally represents any type or form of processing unit capable of processing data or interpreting and executing instructions. In certain embodiments, processor 614 may receive instructions from a software application or module. These instructions may cause processor 614 to perform the functions of one or more of the embodiments described and/or illustrated herein. For example, processor 614 may perform and/or be a means for performing the operations described herein. Processor 614 may also perform and/or be a means for performing any other operations, methods, or processes described and/or illustrated herein.

Memory 616 generally represents any type or form of volatile or non-volatile storage devices or mediums capable of storing data and/or other computer-readable instructions. Examples include, without limitation, random access memory (RAM), read only memory (ROM), flash memory, a hard disk drive, or any other suitable memory device. Although not required, in certain embodiments computing system 600 may include both a volatile memory unit and a non-volatile storage device. In one example, program instructions implementing on or more operations described herein may be loaded into memory 610.

In certain embodiments, computing system 600 may also include one or more components or elements in addition to processor 614 and memory 616. For example, as illustrated in FIG. 6, computing system 600 may include a memory controller 618, an Input/Output (I/O) controller 620, and a communication interface 622, each of which may be interconnected via a communication infrastructure 612. Communication infrastructure 612 generally represents any type or form of infrastructure capable of facilitating communication between one or more components of a computing device. Examples of communication infrastructure 612 include, without limitation, a communication bus (such as an Industry Standard Architecture (ISA), Peripheral Component Interconnect (PCI), PCI express (PCIe), or similar bus) and a network.

Memory controller 618 generally represents any type or form of device capable of handling memory or data or controlling communication between one or more components of computing system 600. For example, in certain embodiments memory controller 618 may control communication between processor 614, memory 616, and I/O controller 620 via communication infrastructure 612. In certain embodiments, memory controller 618 may perform and/or be a means for performing, either alone or in combination with other elements, one or more of the operations or features described and/or illustrated herein.

I/O controller 620 generally represents any type or form of module capable of coordinating and/or controlling the input and output functions of a computing device. For example, in certain embodiments I/O controller 620 may control or facilitate transfer of data between one or more elements of computing system 600, such as processor 614, memory 616, communication interface 622, display adapter 626, input interface 630, and storage interface 634.

Communication interface 622 broadly represents any type or form of communication device or adapter capable of facilitating communication between computing system 600 and one or more additional devices. For example, in certain embodiments communication interface 622 may facilitate communication between computing system 600 and a private or public network including additional computing systems. Examples of communication interface 622 include, without limitation, a wired network interface (such as a network interface card), a wireless network interface (such as a wireless network interface card), a modem, and any other suitable interface. In at least one embodiment, communication interface 622 may provide a direct connection to a remote server via a direct link to a network, such as the Internet. Communication interface 622 may also indirectly provide such a connection through, for example, a local area network (such as an Ethernet network), a personal area network, a telephone or cable network, a cellular telephone connection, a satellite data connection, or any other suitable connection.

In certain embodiments, communication interface 622 may also represent a host adapter configured to facilitate communication between computing system 600 and one or more additional network or storage devices via an external bus or communications channel. Examples of host adapters include, without limitation, Small Computer System Interface (SCSI) host adapters, Universal Serial Bus (USB) host adapters, Institute of Electrical and Electronics Engineers (IEEE) 1894 host adapters, Serial Advanced Technology Attachment (SATA) and external SATA (eSATA) host adapters, Advanced Technology Attachment (ATA) and Parallel ATA (PATA) host adapters, Fibre Channel interface adapters, Ethernet adapters, or the like.

Communication interface 622 may also allow computing system 600 to engage in distributed or remote computing. For example, communication interface 622 may receive instructions from a remote device or send instructions to a remote device for execution.

As illustrated in FIG. 6, computing system 600 may also include at least one display device 624 coupled to communication infrastructure 612 via a display adapter 626. Display device 624 generally represents any type or form of device capable of visually displaying information forwarded by display adapter 626. Similarly, display adapter 626 generally represents any type or form of device configured to forward graphics, text, and other data from communication infrastructure 612 (or from a frame buffer) for display on display device 624.

As illustrated in FIG. 6, computing system 600 may also include at least one input device 628 coupled to communication infrastructure 612 via an input interface 630. Input device 628 generally represents any type or form of input device capable of providing input, either computer or human generated, to computing system 600. Examples of input device 628 include, without limitation, a keyboard, a pointing device, a speech recognition device, or any other input device.

As illustrated in FIG. 6, computing system 600 may also include a storage device 632 coupled to communication infrastructure 612 via a storage interface 634. Storage device 632 generally represents any type or form of storage device or medium capable of storing data and/or other computer-readable instructions. For example, storage device 632 may be a magnetic disk drive (e.g., a so-called hard drive), a floppy disk drive, a magnetic tape drive, an optical disk drive, a flash drive, or the like. Storage interface 634 generally represents any type or form of interface or device for transferring data between storage device 632 and other components of computing system 600. A storage device like storage device 632 can store information such as the data structures described herein, as well as one or more computer-readable programming instructions that are capable of causing a computer system to execute one or more of the operations described herein.

In certain embodiments, storage device 632 may be configured to read from and/or write to a removable storage unit configured to store computer software, data, or other computer-readable information. Examples of suitable removable storage units include, without limitation, a floppy disk, a magnetic tape, an optical disk, a flash memory device, or the like. Storage device 632 may also include other similar structures or devices for allowing computer software, data, or other computer-readable instructions to be loaded into computing system 600. For example, storage device 632 may be configured to read and write software, data, or other computer-readable information. Storage devices 632 may also be a part of computing system 600 or may be a separate device accessed through other interface systems.

Many other devices or subsystems may be connected to computing system 600. Conversely, all of the components and devices illustrated in FIG. 6 need not be present to practice the embodiments described and/or illustrated herein. The devices and subsystems referenced above may also be interconnected in different ways from that shown in FIG. 6.

Computing system 600 may also employ any number of software, firmware, and/or hardware configurations. For example, one or more of the embodiments disclosed herein may be encoded as a computer program (also referred to as computer software, software applications, computer-readable instructions, or computer control logic) on a non-transient computer-readable storage medium. Examples of non-transient computer-readable storage media include magnetic-storage media (e.g., hard disk drives and floppy disks), optical-storage media (e.g., CD- or DVD-ROMs), electronic-storage media (e.g., solid-state drives and flash media), and the like. Such computer programs can also be transferred to computing system 600 for storage in memory via a network such as the Internet or upon a carrier medium.

The non-transient computer-readable storage medium containing the computer programming instructions may be loaded into computing system 600. All or a portion of the computer programming instructions stored on the non-transient computer-readable storage medium may then be stored in memory 616 and/or various portions of storage device 632. When executed by processor 614, a computer program loaded into computing system 600 may cause processor 614 to perform and/or be a means for performing the functions of one or more of the embodiments described and/or illustrated herein. Additionally or alternatively, one or more of the embodiments described and/or illustrated herein may be implemented in firmware and/or hardware. For example, computing system 600 may be configured as an application specific integrated circuit (ASIC) adapted to implement one or more of the embodiments disclosed herein.

Figure 7:
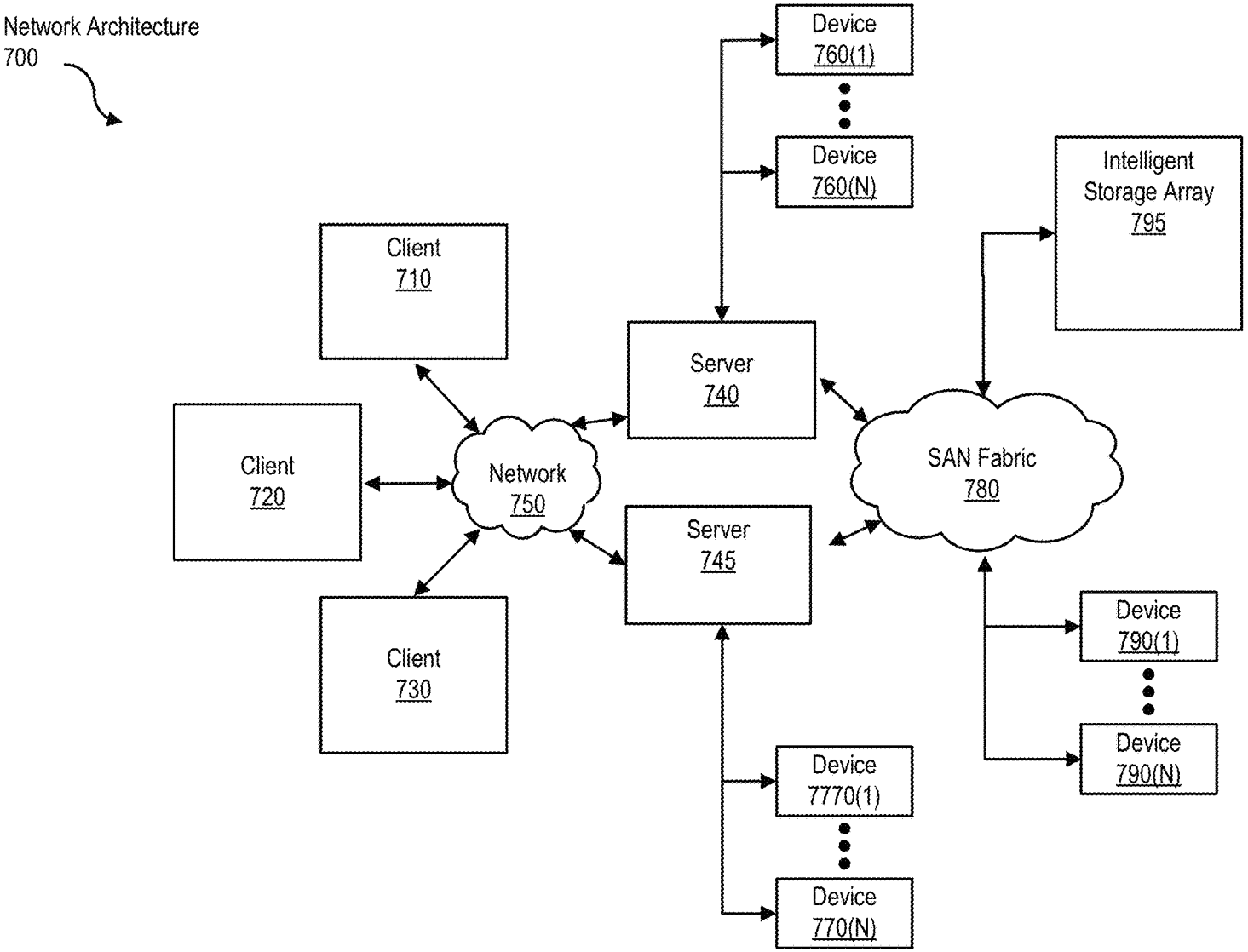
FIG. 7 is a block diagram of a networked system, illustrating how various computing devices can communicate via a network, according to one embodiment of the present disclosure.

FIG. 7 is a block diagram of a network architecture 700 in which client systems 710, 720, and 730, and servers 740 and 745 may be coupled to a network 750. Client systems 710, 720, and 730 generally represent any type or form of computing device or system, such as computing system 600 in FIG. 6.

Similarly, servers 740 and 745 generally represent computing devices or systems, such as application servers or database servers, configured to provide various database services and/or run certain software applications. Network 750 generally represents any telecommunication or computer network including, for example, an intranet, a wide area network (WAN), a local area network (LAN), a personal area network (PAN), or the Internet. In one example, one or more of client systems 710, 720, and/or 730 may include software configured to execute, e.g., Preprocessing Module 141, Parlay Selection Module 143, Parlay Validation Module 145, and/or Odds Processing & Servicing Module 151, and/or one or more components or threads thereof.

As illustrated in FIG. 7, one or more storage devices 760(1)-(N) may be directly attached to server 740. Similarly, one or more storage devices 770(1)-(N) may be directly attached to server 745. Storage devices 760(1)-(N) and storage devices 770(1)-(N) generally represent any type or form of storage device or medium capable of storing data and/or other computer-readable instructions. In certain embodiments, storage devices 760(1)-(N) and storage devices 770(1)-(N) may represent network-attached storage (NAS) devices configured to communicate with servers 740 and 745 using various protocols, such as Network File System (NFS), Server Message Block (SMB), or Common Internet File System (CIFS). Such storage devices can store backup information and storage configuration information, as described above.

Servers 740 and 745 may also be connected to a storage area network (SAN) fabric 780. SAN fabric 780 generally represents any type or form of computer network or architecture capable of facilitating communication between multiple storage devices. SAN fabric 780 may facilitate communication between servers 740 and 745 and a plurality of storage devices 790(1)-(N) and/or an intelligent storage array 795. SAN fabric 780 may also facilitate, via network 750 and servers 740 and 745, communication between client systems 710, 720, and 730 and storage devices 790(1)-(N) and/or intelligent storage array 795 in such a manner that devices 790(1)-(N) and array 795 appear as locally attached devices to client systems 710, 720, and 730. As with storage devices 760(1)-(N) and storage devices 770(1)-(N), storage devices 790(1)-(N) and intelligent storage array 795 generally represent any type or form of storage device or medium capable of storing data and/or other computer-readable instructions.

In certain embodiments, and with reference to computing system 600 of FIG. 6, a communication interface, such as communication interface 622 in FIG. 6, may be used to provide connectivity between each client system 710, 720, and 730 and network 750. Client systems 710, 720, and 730 may be able to access information on server 740 or 745 using, for example, a web browser or other client software. Such software may allow client systems 710, 720, and 730 to access data hosted by server 740, server 745, storage devices 760(1)-(N), storage devices 770(1)-(N), storage devices 790(1)-(N), or intelligent storage array 795. Although FIG. 7 depicts the use of a network (such as the Internet) for exchanging data, the embodiments described and/or illustrated herein are not limited to the Internet or any particular network-based environment.

In at least one embodiment, all or a portion of one or more of the embodiments disclosed herein may be encoded as a computer program and loaded onto and executed by server 740, server 745, storage devices 740(1)-(N), storage devices 770(1)-(N), storage devices 790(1)-(N), intelligent storage array 795, or any combination thereof. All or a portion of one or more of the embodiments disclosed herein may also be encoded as a computer program, stored in server 740, run by server 745, and distributed to client systems 710, 720, and 730 over network 750.

In some examples, all or a portion of one of the systems in FIGS. 1A, 1B, 1C, 6, and 7 may represent portions of a cloud-computing or network-based environment. Cloud-computing environments may provide various services and applications via the Internet. These cloud-based services (e.g., software as a service, platform as a service, infrastructure as a service, etc.) may be accessible through a web browser or other remote interface. Various functions described herein may be provided through a remote desktop environment or any other cloud-based computing environment.

In addition, one or more of the components described herein may transform data, physical devices, and/or representations of physical devices from one form to another. For example, one or more of the operations described herein may transform the behavior of a computer system such that the various operations described herein can be performed.

Although the present invention has been described in connection with several embodiments, the invention is not intended to be limited to the specific forms set forth herein. On the contrary, it is intended to cover such alternatives, modifications, and equivalents as can be reasonably included within the scope of the invention as defined by the appended claims.

What is claimed is:

1. A method comprising:

receiving one or more parlay parameters, wherein the one or more parlay parameters are provided by a user of a gaming terminal;

determining one or more available parlay options, wherein the one or more available parlay options satisfy the one or more parlay parameters;

transmitting the one or more available parlay options to the gaming terminal; and receiving a parlay selection, wherein the parlay selection corresponds to a parlay option among the one or more available parlay options;

wherein determining the one or more available parlay options comprises:

determining a plurality of event outcomes;

converting a plurality of moneylines corresponding to the plurality of event outcomes, respectively, to a plurality of natural logarithm values, respectively.

2. The method of claim 1, wherein the one or more parlay parameters comprise at least one of an event category, a ticket price, a parlay size, and a ticket win value.

3. The method of claim 1, wherein the plurality of event outcomes satisfy the one or more parlay parameters.

4. The method of claim 3, wherein the one or more available parlay options are further determined, at least in part, in a manner that satisfies one or more group constraints associated with the plurality of available events.

5. The method of claim 1, wherein the determining the one or more available parlay options further comprises adding two or more of the plurality of natural logarithm values to generate a result;

comparing the result to a target natural logarithm.

6. The method of claim 1, wherein the determining the one or more available parlay options is performed in less than ten seconds.

7. The method of claim 1, further comprising confirming that the parlay selection is valid;

subsequent to the confirming, updating risk information, wherein the updating is based, at least in part, on the parlay selection; and subsequent to the confirming, returning a confirmation message to the gaming terminal, wherein the confirmation message comprises information configured to be used to print a ticket.

8. A system comprising:

a microprocessor; and a non-transient computer-readable storage medium, comprising computer instructions executable by the microprocessor, wherein the computer instructions are configured to perform a method comprising:

receiving one or more parlay parameters, wherein the one or more parlay parameters are provided by a user of a gaming terminal;

determining one or more available parlay options, wherein the one or more available parlay options satisfy the one or more parlay parameters;

transmitting the one or more available parlay options to the gaming terminal; and receiving a parlay selection, wherein the parlay selection corresponds to a parlay option among the one or more available parlay options;

wherein determining the one or more available parlay options comprises:

determining a plurality of event outcomes;

converting a plurality of moneylines corresponding to the plurality of event outcomes, respectively, to a plurality of natural logarithm values, respectively.

9. The system of claim 8, wherein the one or more parlay parameters comprise at least one of an event category, a ticket price, a parlay size, and a ticket win value.

10. The system of claim 8, wherein the plurality of event outcomes satisfy the one or more parlay parameters.

11. The system of claim 10, wherein the one or more available parlay options are further determined, at least in part, in a manner that satisfies one or more group constraints associated with the plurality of available events.

12. The system of claim 8, wherein the determining the one or more available parlay options further comprises adding two or more of the plurality of natural logarithm values to generate a result;

comparing the result to a target natural logarithm.

13. The system of claim 8, wherein the determining the one or more available parlay options is performed in less than ten seconds.

14. The system of claim 8, wherein the method further comprises:

confirming that the parlay selection is valid;

subsequent to the confirming, updating risk information, wherein the updating is based, at least in part, on the parlay selection; and subsequent to the confirming, returning a confirmation message to the gaming terminal, wherein the confirmation message comprises information configured to be used to print a ticket.

15. A computer program product, comprising a plurality of instructions stored on a non-transient computer-readable storage medium, wherein the instructions are configured to execute a method comprising the steps of:

receiving one or more parlay parameters, wherein the one or more parlay parameters are provided by a user of a gaming terminal;

determining one or more available parlay options, wherein the one or more available parlay options satisfy the one or more parlay parameters;

transmitting the one or more available parlay options to the gaming terminal; and receiving a parlay selection, wherein the parlay selection corresponds to a parlay option among the one or more available parlay options;

wherein determining the one or more available parlay options comprises:

determining a plurality of event outcomes;

converting a plurality of moneylines corresponding to the plurality of event outcomes, respectively, to a plurality of natural logarithm values, respectively.

16. The computer program product of claim 15, wherein the one or more parlay parameters comprise at least one of an event category, a ticket price, a parlay size, and a ticket win value.

17. The computer program product of claim 15, wherein the plurality of event outcomes determining a plurality of event outcomes that satisfy the one or more parlay parameters, wherein the determining the one or more available parlay options is performed in less than ten seconds.

18. The computer program product of claim 17, wherein the one or more available parlay options are further determined, at least in part, in a manner that satisfies one or more group constraints associated with the plurality of available events.

19. The computer program product of claim 15, wherein the determining the one or more available parlay options further comprises adding two or more of the plurality of natural logarithm values to generate a result;

comparing the result to a target natural logarithm.

20. The computer program product of claim 15, wherein the method further comprises:

confirming that the parlay selection is valid;

subsequent to the confirming, updating risk information, wherein the updating is based, at least in part, on the parlay selection; and subsequent to the confirming, returning a confirmation message to the gaming terminal, wherein the confirmation message comprises information configured to be used to print a ticket.

* * * * *